US007589699B2

(12) United States Patent
Miyazawa

(10) Patent No.: US 7,589,699 B2
(45) Date of Patent: Sep. 15, 2009

(54) ELECTRONIC CIRCUIT, ELECTRO-OPTICAL DEVICE, METHOD FOR DRIVING ELECTRO-OPTICAL DEVICE AND ELECTRONIC APPARATUS

(75) Inventor: Takashi Miyazawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 469 days.

(21) Appl. No.: 11/451,431

(22) Filed: Jun. 13, 2006

(65) Prior Publication Data

US 2006/0227083 A1 Oct. 12, 2006

Related U.S. Application Data

(62) Division of application No. 10/630,860, filed on Jul. 31, 2003, now Pat. No. 7,145,530.

(30) Foreign Application Priority Data

Aug. 7, 2002 (JP) ..... 2002-230292

(51) Int. Cl.
*G09G 3/30* (2006.01)

(52) U.S. Cl. ..... 345/76; 345/55; 345/84; 345/89; 345/211; 345/690

(58) Field of Classification Search ..... 345/50–55, 345/87–103, 204–215, 690–699, 76–84
See application file for complete search history.

(56) References Cited

U.S. PATENT DOCUMENTS

| | | | | |
|---|---|---|---|---|
| 5,903,246 | A | 5/1999 | Dingwall | |
| 5,952,789 | A | 9/1999 | Stewart et al. | |
| 6,091,203 | A | 7/2000 | Kawashima et al. | |
| 6,160,533 | A | 12/2000 | Tamai et al. | |
| 6,229,506 | B1 | 5/2001 | Dawson et al. | |
| 6,229,508 | B1 | 5/2001 | Kane | |
| 6,433,835 | B1 | 8/2002 | Hartson et al. | |
| 6,475,845 | B2 | 11/2002 | Kimura | |
| 6,501,466 | B1 | 12/2002 | Yamagishi et al. | |
| 6,738,034 | B2 | 5/2004 | Kaneko et al. | |
| 6,885,029 | B2 | 4/2005 | Miyazawa | |
| 7,145,530 | B2 * | 12/2006 | Miyazawa | 345/76 |
| 2003/0132906 | A1 | 7/2003 | Tanaka et al. | |

FOREIGN PATENT DOCUMENTS

| | | |
|---|---|---|
| JP | A 06-301355 | 10/1994 |
| JP | A 2002-032048 | 1/2002 |
| JP | A 2002-091376 | 3/2002 |
| JP | A 2002-175029 | 6/2002 |
| JP | A 2002-189447 | 7/2002 |

(Continued)

*Primary Examiner*—Vijay Shankar
(74) *Attorney, Agent, or Firm*—Oliff & Berridge, PLC

(57) ABSTRACT

A drive current corresponding to a digital-data voltage or an analog-data voltage transmitted via a data line can be transmitted to an organic EL element of a pixel circuit provided corresponding to the intersection of a scan line and the data line. The digital-data voltage can be transmitted to the pixel circuit so as to control gray scale by digital-gray-scale modulation for decreasing power consumption. Further, the analog-data voltage can be transmitted to the pixel circuit so as to control the gray scale by analog-gray-scale modulation for increasing the display quality.

10 Claims, 10 Drawing Sheets

FOREIGN PATENT DOCUMENTS

| | | |
|---|---|---|
| JP | A 2002-207442 | 7/2002 |
| JP | A 2003-099007 | 4/2003 |
| JP | A 2005-510768 | 4/2005 |
| WO | WO 01/15232 A1 | 3/2001 |
| WO | WO 03/046877 A1 | 6/2003 |

* cited by examiner

ELECTRONIC CIRCUIT, ELECTRO-OPTICAL DEVICE, METHOD FOR DRIVING ELECTRO-OPTICAL DEVICE AND ELECTRONIC APPARATUS

This is a Division of application Ser. No. 10/630,860 filed Jul. 31, 2003. The entire disclosure of the prior application is hereby incorporated by reference herein in its entirety.

BACKGROUND OF THE INVENTION

1. Field of Invention

The present invention relates to an electronic circuit, an electro-optical device, a method for driving the electro-optical device, and an electronic apparatus.

2. Description of Related Art

Recently, much attention has been given to display device using an electro-optical device including an organic EL element. For this type of electro-optical devices, various types of analog-gray-scale-modulation methods can be used as a driving method for controlling the gray scale of the organic EL element. According to one of the analog-gray-scale-modulation methods, the voltage between the gate and source of a driving transistor can be rendered as the threshold voltage thereof for driving, the driving transistor being provided for transmitting a current to the organic EL element. According to this method, a voltage (a data voltage) transmitted from a DA-converter circuit according to the luminance gray scale is held in a holding capacitor of a pixel circuit. The data voltage charged in the holding capacitor is transmitted to a gate terminal of the driving transistor formed of a thin-film transistor (TFT). The driving transistor transmits a drive current with a value corresponding to the data voltage to the organic EL element.

It is difficult to form the DA-converter circuit with precision by using the thin-film transistor (TFT) forming the pixel circuit, the DA-converter circuit being used in the case where the analog-gray-scale-modulation method is applied. Therefore, in general, the DA-converter circuit is formed by using an external IC driver.

However, the electrical power consumption of the DA-converter circuit formed of the external IC driver is larger than that of a TFT-driver circuit formed on a display panel. In this case, a digital-gray-scale-modulation method may be used according to the reason described below. Since the digital-gray-scale-modulation method does not require the use of the DA-converter circuit for generating a multilevel value (an analog value), the electrical-power consumption can be reduced. However, the display quality obtained according to the digital-gray-scale-modulation method is lower than that in the case where the analog-gray-scale-modulation method is applied.

SUMMARY OF THE INVENTION

The present invention takes into account the above-described problems. An object of the present invention is to provide an electronic circuit that can achieve adequate display quality by a small amount of electrical power, an electro-optical device, a method for driving the electro-optical device, and an electronic apparatus.

An electronic circuit of the present invention can include a first transistor that becomes conductive when a scan line is selected, a capacitive element for holding an electrical-charge amount according to a data signal transmitted from a data line via the first transistor, and a second transistor whose conduction state is controlled, based on the electrical-charge amount held in the capacitive element. The second transistor can be used for transmitting a current amount corresponding to the conduction state to an electronic element. The electrical-charge amount according to the data signal can be accumulated in the capacitive element in the case where either a two-level-data voltage or a multilevel-data voltage is transmitted as the data signal.

Accordingly, either the two-level-data voltage or the multilevel-data voltage can be used as required, whereby a gray-scale image can be presented according to the digital-gray-scale-modulation method and the analog-gray-scale-modulation method. As a result, the digital-gray-scale-modulation method can be selected in the case where high display quality is not required and a small amount of electrical power is consumed. On the other hand, the gray-scale image can be presented according to the analog-gray-scale-modulation method in the case where high display quality is required.

In this electronic circuit, the two-level-data voltage and the multilevel-data voltage are transmitted via the first switching transistor. Accordingly, the two-level-data voltage is transmitted to the capacitive element via the first switching transistor for performing the digital-gray-scale modulation, and the multilevel voltage is transmitted to the capacitive element via the first switching transistor for performing the analog-gray-scale modulation.

This electronic circuit further comprises a third transistor for resetting the electrical-charge amount held in the capacitive element. Accordingly, the two-level-data voltage held in the capacitive element is reset by the third transistor, and the capacitive element waits until the next two-level-data voltage is transmitted thereto.

The electronic circuit can further include a fourth transistor that becomes conductive, based on the multilevel-data voltage, and that is connected between the gate and drain of the second transistor, the fourth transistor being used for compensating the threshold voltage of the second transistor. Accordingly, variations in threshold voltage of the second transistor are compensated by the fourth transistor, whereby the second transistor can become conductive according to the multilevel-data voltage without being affected by the threshold voltage thereof.

The electronic circuit further comprises a fifth transistor that becomes conductive, based on the multilevel-data voltage, and that determines the timing of driving the electronic element. Accordingly, a current amount according to the conduction state on the basis of the multilevel-data voltage of the second transistor is transmitted to the electronic element by the fifth transistor, whereby the electronic element is driven.

The electronic element used in the electronic circuit is an EL element. Accordingly, the EL element emits light according to the conduction state of the second transistor.

The EL element in this electronic circuit can include a light-emission layer formed of an organic material.

The EL element can be an organic EL element that can have the light-emission layer formed of the organic material.

An electro-optical device of the present invention include a plurality of scan lines, a plurality of data lines, a plurality of unit circuits, a first data-voltage output circuit for outputting a two-level-data voltage as a data signal to each of the plurality of unit circuits via the plurality of data lines, and a second data-voltage output circuit for outputting a multilevel-data voltage to each of the plurality of unit circuits via the plurality of data lines. Subsequently, the digital-gray-scale modulation can be performed by inputting the two-level-data voltage via the first data-voltage output circuit, and the analog-gray-scale modulation can be performed by inputting the multilevel-data voltage via the second data-voltage output circuit.

In the electro-optical device, the two-level-data voltage and the multilevel-data voltage can be transmitted via one and the same data line. Therefore, the two-level-data voltage and the multilevel-data voltage are transmitted via one and the same data line in the case where either the digital-gray-scale modulation or the analog-gray-scale modulation is performed.

In the electro-optical device, the two-level-data voltage and the multilevel-data voltage are transmitted via the data lines that are different from each other. Therefore, the data line through which the two-level-data voltage is transmitted to the unit circuit in the case where the digital-gray-scale modulation is performed is different from that through which the multilevel-data voltage is transmitted to the unit circuit in the case where the analog-gray-scale modulation is performed.

An electro-optical device of the present invention can include a plurality of scan lines, a plurality of data lines provided so as to cross the scan lines, a unit circuit that is provided so as to correspond to each of the intersections of the scar lines and the data lines and that transmits a drive current according to a data voltage transmitted via the data line to an electro-optical element, and a control device that generates and outputs either a two-level-data voltage for applying digital-gray-scale modulation to the electro-optical element or a multilevel-data voltage for applying analog-gray-scale modulation to the electro-optical element, based on image data.

Accordingly, the control device can present a gray-scale image according to two methods, that is to say, by applying the digital-gray-scale modulation to the electro-optical element and applying the analog-gray-scale modulation to the electro-optical element. As a result, the digital-gray-scale modulation is selected in the case where high display quality is not required and a small amount of electrical power is consumed. On the other hand, the gray-scale image can be presented by the analog-gray-scale modulation in the case where high display quality is required.

The unit circuit in the electro-optical device can include a first transistor that becomes conductive when the scan line is selected, a capacitive element for holding either a two-level-data voltage for digital-gray-scale modulation or a multilevel-data voltage for analog-gray-scale modulation transmitted from the data line via the first transistor as an electrical-charge amount, and a second transistor whose conduction state is controlled, based on the electrical-charge amount held in the capacitive element. The second transistor can be used for transmitting a current amount corresponding to the conduction state to the electro-optical element.

Accordingly, the capacitive element holds the two-level-data voltage in the case where the digital-gray-scale modulation is performed. The second transistor becomes conductive and non-conductive, based on the two-level-data voltage held in the capacitive element. The capacitive element holds the multilevel-data voltage in the case where the analog-gray-scale modulation is performed. The second transistor becomes conductive according to the multilevel-data voltage held in the capacitive element.

The unit circuit in the electro-optical device can further include a third transistor for resetting the electrical-charge amount held in the capacitive element. Therefore, the two-level-data voltage held in the capacitive element is reset by the third transistor, and the capacitive element waits until the next two-level-data voltage is transmitted.

In the electro-optical device, the unit circuit can further include a fourth transistor for compensating the threshold voltage of the second transistor, the fourth transistor being connected between the threshold voltage of the second transistor when the analog-gray-scale modulation is performed. Accordingly, variations in threshold voltage of the second transistor are compensated by the fourth transistor, whereby the second transistor becomes conductive according to the multilevel-data voltage without being affected by the threshold voltage thereof.

The unit circuit of the electro-optical device further comprises a fifth transistor for determining the timing of driving the electro-optical element. Therefore, the fifth transistor transmits a current amount according to the conduction state on the basis of the multilevel-data voltage of the second transistor to the electro-optical element, whereby light emission is started.

The electro-optical element in the electro-optical device is an EL element. Therefore, the EL element emits light according to the conduction state of the second transistor.

The EL element in the electro-optical device has a light-emission layer formed of an organic material. Therefore, the EL element is an organic EL element having the light-emission layer formed of the organic material.

In the electro-optical device, the control device can generate the two-level-data voltage for applying the digital-gray-scale modulation to the electro-optical element in low-electrical-power-consumption mode and the multilevel-data voltage for applying the analog-gray-scale modulation to the electro-optical element in non-low-electrical-power-consumption mode for driving the electro-optical element. Therefore, the control means can present the gray-scale image by applying digital-gray-scale modulation to the electro-optical element in low-electrical-power-consumption mode and applying analog-gray-scale modulation to the electro-optical element in non-low-electrical-power-consumption mode.

In the electro-optical device, the control device can generate the two-level-data voltage for applying the digital-gray-scale modulation to the electro-optical element when the image data is first display data and the multilevel-data voltage for applying the analog-gray-scale modulation to the electro-optical element when the image data is second display data whose display quality is higher than that of the first display data for driving the electro-optical element. Therefore, the control means can present the gray-scale image by applying digital-gray-scale modulation to the electro-optical element in the case where high display quality is not required and applying analog-gray-scale modulation to the electro-optical element in the case where the high display quality is required.

In the electro-optical device, the control device can include a two-level-data-voltage generation circuit for generating the two-level-data voltage for applying the digital-gray-scale modulation to the electro-optical element, and a multilevel-data-voltage generation circuit for generating the multilevel-data voltage for applying the analog-gray-scale modulation to the electro-optical element. Therefore, the two-level-data-voltage generation circuit generates the two-level-data voltage for performing the digital-gray-scale modulation. Further, the multilevel-data voltage is generated in the multilevel-data-voltage generation circuit for performing the analog-gray-scale modulation.

The electro-optical device can further include a first output circuit for outputting the two-level-data voltage transmitted from the two-level-data-voltage generation circuit and a second output circuit for outputting the multilevel-data voltage transmitted from the multilevel-data-voltage generation circuit between the control device and each of the data line, and further can include a switching circuit for outputting either the two-level-data voltage from the first output circuit or the multilevel-data voltage from the second output circuit to the data line. Therefore, through the use of the switching circuit, the two-level-data voltage is output from the first output circuit to the data line in the case where the digital-gray-scale modulation is performed and the multilevel-data voltage is output from the second output circuit to the data line in the case where the analog-gray-scale modulation is performed.

In the electro-optical device, the digital-gray-scale modulation is time-ratio gray-scale modulation. Therefore, in the case of this electro-optical element, the gray scale is controlled according to the time-ratio gray-scale method.

In the electro-optical device, the time-ratio gray-scale modulation can be performed by writing the two-level-data voltage into the unit circuit corresponding to one of the scan lines selected in sequence and starting transmission of a current with a level according the two-level-data voltage to the electro-optical element at the same instant, and stopping the current transmission to the electro-optical element after a predetermined time. Therefore, in the case of this electro-optical element, the two-level-data voltage is written into the unit circuit corresponding to one of the scan lines selected in sequence. At the same instant, transmission of a current with a level according to the two-level-data voltage to the electro-optical element is started. The current transmission is stopped after the predetermined time, whereby the gray scale is controlled.

A method for driving an electro-optical device having a plurality of scan lines, a plurality of data lines provided so as to cross the scan lines, and a unit circuit that is provided so as to correspond to each of the intersections of the scan lines and the data lines and that transmits a drive current according to a data voltage transmitted via the data line to an electro-optical element, the electro-optical element can be driven by generating a two-level-data voltage for applying digital-gray-scale modulation to the electro-optical element in low-electrical-power-consumption mode and a multilevel-data voltage for applying analog-gray-scale modulation to the electro-optical element in non-low-electrical-power-consumption mode. Subsequently, in the case where this electro-optical element is used, the gray scale is controlled by performing the digital-gray-scale modulation in low-electrical-power-consumption mode and performing the analog-gray-scale modulation in non-low-electrical-power-consumption mode.

A method for driving an electro-optical device having a plurality of scan lines, a plurality of data lines provided so as to cross the scan lines, and a unit circuit that is provided so as to correspond to each of the intersections of the scan lines and the data lines and that transmits a drive current according to a data voltage transmitted via the data line to an electro-optical element, the electro-optical element can be driven by generating a two-level-data voltage for applying digital-gray-scale modulation to the electro-optical element when image data is first display data and a multilevel-data voltage for applying analog-gray-scale modulation to the electro-optical element when the image data is second display data whose display quality is higher than that of the first display data. Therefore, in the case of this electro-optical element, the gray scale is controlled by performing the digital-gray-scale modulation in the case where high display quality is not required and performing the analog-gray-scale modulation in the case where high display quality is required.

According to this method for driving the electro-optical device, the digital-gray-scale modulation is time-ratio gray-scale modulation. Therefore, in the case of this electro-optical element, the gray scale is controlled by the time-ratio gray-scale modulation.

According to the method for driving the electro-optical device, the time-ratio gray-scale modulation is performed by writing the two-level-data voltage into the unit circuit corresponding to one of the scan lines selected in sequence and starting transmission of a current with a level according the two-level-data voltage to the electro-optical element at the same instant, and stopping the current transmission to the electro-optical element after a predetermined time. Therefore, the two-level-data voltage is written into the unit circuit corresponding to one of the scan lines selected in sequence. At the same instant, transmission of a current with a level according the two-level-data voltage to the electro-optical element is started. The current transmission to the electro-optical element is stopped after the predetermined time, whereby the gray scale is controlled.

An electronic apparatus of the present invention can have an electro-optical device according to the present invention mounted thereon. Accordingly, adequately high display quality can be achieved by a small amount of electrical power.

BRIEF DESCRIPTION OF THE DRAWINGS

The invention will be described with reference to the accompanying drawings, wherein like numerals reference like elements, and wherein.

DETAILED DESCRIPTION OF PREFERRED EMBODIMENTS

A first embodiment of the present invention will be described with reference to FIGS. 1 to 3.

Figure 1:
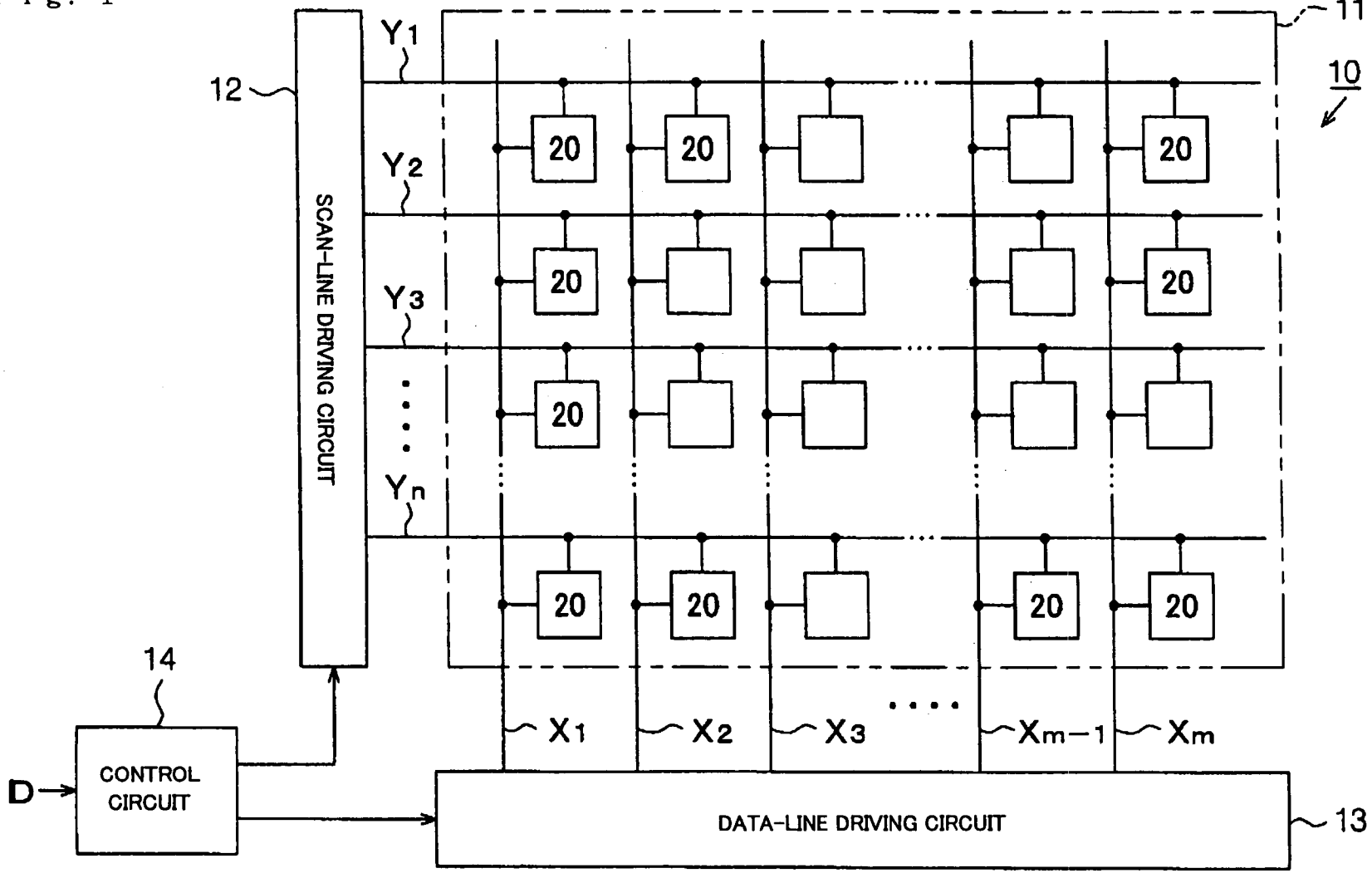
FIG. 1 is an exemplary block-circuit diagram showing the circuit configuration of an organic EL display, the block-circuit diagram being provided for illustrating a first embodiment of the present invention.

FIG. 1 is an exemplary block-circuit diagram illustrating the electrical configuration of an organic EL display 10 functioning as an electro-optical device. According to this drawing, the organic EL display 10 is a display that can present a gray-scale image by either digital-gray-scale modulation or analog-gray-scale modulation. More specifically, the digital-gray-scale modulation is time-ratio gray-scale modulation according to this embodiment. According to this time-ratio gray-scale modulation, the two-level-data voltage is written into a pixel circuit corresponding to one of scan lines that are selected in sequence. At the same instant, transmission of a current with a level according to the two-level-data voltage to an electro-optical element is started. After a predetermined time elapsed, the current transmission to the electro-optical element is stopped, whereby a 64-gray-scale image is presented. In the case where the analog-gray-scale modulation is performed, the voltage between the gate and source of a driving transistor is rendered as the threshold voltage thereof for driving. The driving transistor transmits a current to the electro-optical element, the current having a level corresponding to a multilevel-data voltage. Accordingly, the gray-scale image is presented.

In the case where the time-division gray-scale modulation is performed, scanning (one frame) performed for displaying one image is divided into six frames. The six divided frames are referred to as sub frames SF1 to SF6. In the sub frames SF1 to SF6, the scan lines are selected in sequence. At the instant when the scan lines are selected, organic EL elements on each selected scan line emit light. Then, the organic EL elements go out in sequence, after a predetermined time (a light-emission time) elapsed, respectively.

The sub frames SF1 to SF6 include light-emission time-periods TL1 to TL6, respectively. These light-emission time-periods TL1 to TL6 are specified as below.

32TL1=16TL2=8TL3=4TL4=2TL5=TL6

The ratio among the light-emission time-periods is determined as below.

TL1:TL2:TL3:TL4:TL5:TL6=1:2:4:8:16:32

For obtaining "7"-luminance gray scale, the pixel circuits are driven within a time period from the first sub frame SF1 to the third sub frame SF3 so that the organic EL elements emit light, and the pixel circuits are stopped within a time period from the fourth sub frame SF4 to the sixth sub frame SF6 so that the organic EL elements go out.

For obtaining "32"-luminance gray scale, the pixel circuits are driven within the sixth sub frame SF6 so that the organic EL elements emit light, and the pixel circuits are stopped within a time period from the first frame SF1 to fifth sub frames SF5 so that the organic EL elements go out.

For obtaining "44"-luminance gray scale, the pixel circuits are driven within the third sub frame SF3, the fourth sub frame SF4, and the sixth sub frame SF6 so that the organic EL elements emit light. Then, the pixel circuits are stopped within the first sub frame SF1, the second sub frame SF2, and the fifth sub frame SF5 so that the organic EL elements go out.

As described above, the gray scale can be obtained by selecting suitable sub frames among the sub frames SF1 to SF6 per one frame.

According to FIG. 1, the organic EL display 10 includes a display panel 11, a scan-line driving circuit 12, a data-line driving circuit 13, and a control circuit 14. The display panel 11, the scan-line driving circuit 12, the data-line driving circuit 13, and the control circuit 14 that are included in the organic EL display 10 may be formed as electronic parts that are independent of one another. For example, the scan-line driving circuit 12, the data-line driving circuit 13, and the control circuit 14 may be formed as a semiconductor integrated circuit on a chip. Further, all or part of the display panel 11, the scan-line driving circuit 12, the data-line driving circuit 13, and the control circuit 14 may be integrated into one electronic part. For example, the data-line driving circuit 13 and the scan-line driving circuit 12 may be integrated into the display panel 11. All or part of the scan-line driving circuit 12, the data-line driving circuit 13, and the control circuit 14 may be integrated into a programmable IC chip. In this case, the functions of these parts may be realized by software, that is, a program written into the IC chip.

The display panel 11 has a plurality of pixel circuits 20 arranged in a matrix form, as shown in FIG. 1. The pixel circuits 20 function as electronic circuits and/or unit circuits. In other words, the pixel circuits 20 are provided in positions corresponding to the intersections of a plurality of (m) data lines X1 to Xm (m is an integer), the data lines extending in a direction along the rows of the display panel 11, and a plurality of (n) scan lines Y1 to Yn (n is an integer), the scan lines extending in a direction along the columns of the display panel 11. Since each of the pixel circuits 20 are connected between one of the data lines X1 to Xm corresponding thereto and one of the scan lines Y1 to Yn corresponding thereto, the pixel circuits 20 are arranged in a matrix form. Each of the pixel circuit 20 has an organic EL element 21 functioning as an electronic element or an electro-optical element. The organic EL element 21 has a light-emission layer formed of an organic material. Transistors that will be described later and that are formed in each pixel circuit 20 are usually formed as a thin-film transistor (TFT).

Figure 2:
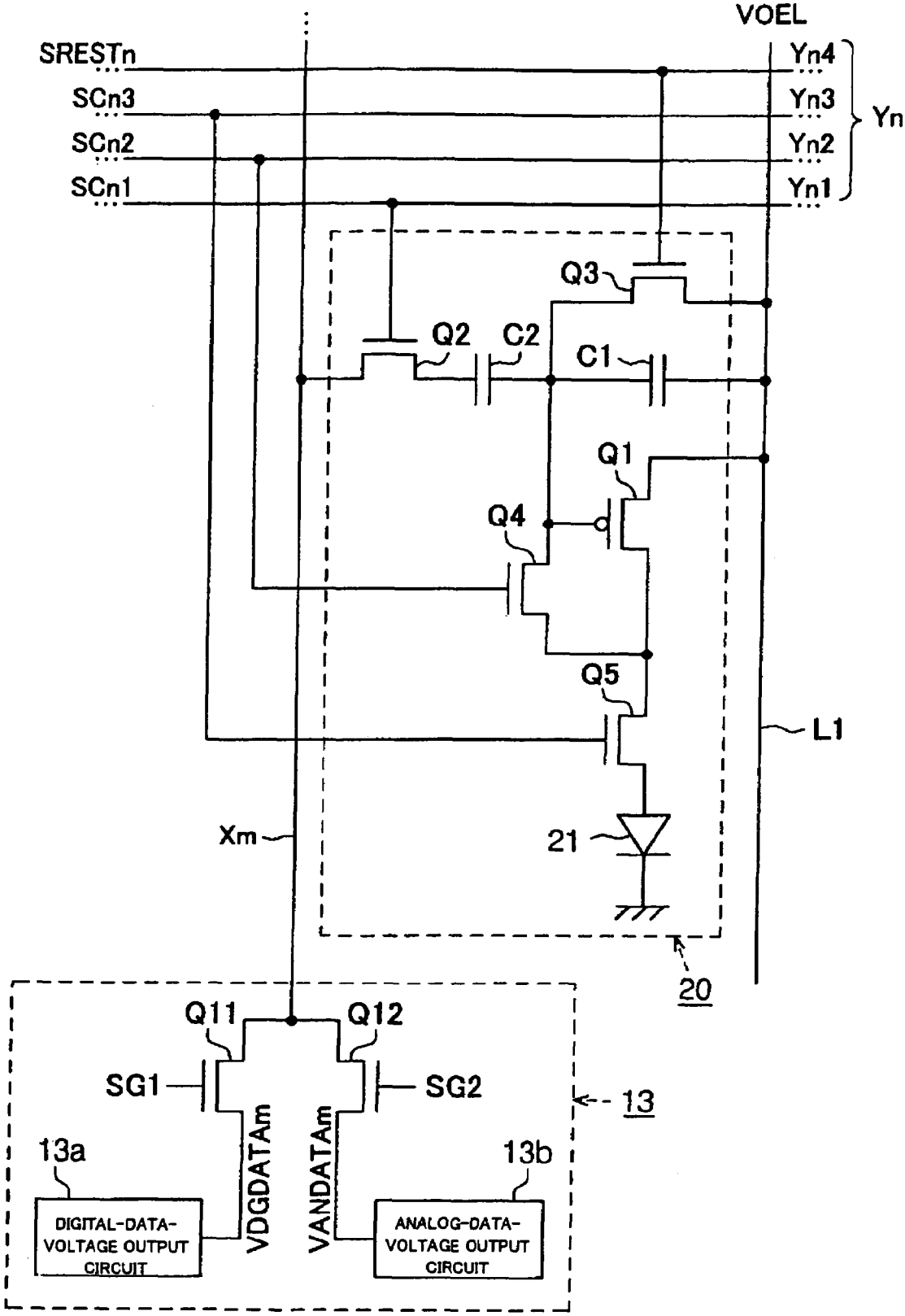
FIG. 2 is an exemplary circuit diagram showing the internal-circuit configuration of a pixel circuit and that of a data-line driving circuit, the circuit diagram being provided for illustrating the first embodiment.
Figure 3:
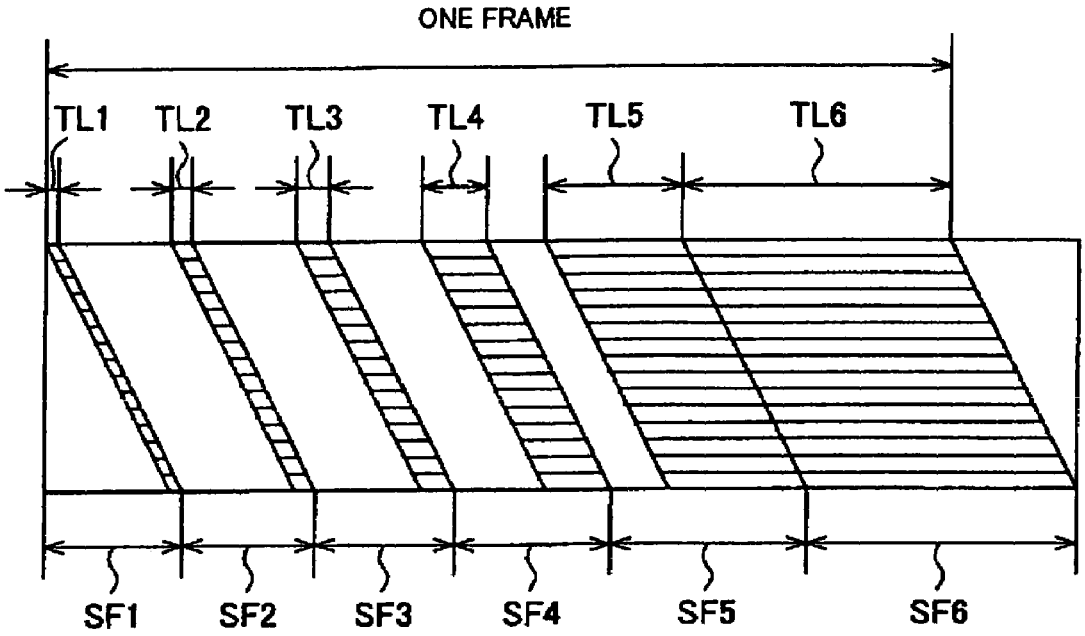
FIG. 3 illustrates time-ratio gray-scale modulation according to the first embodiment.

FIG. 2 is an exemplary electrical-circuit diagram illustrating the internal configuration of the pixel circuit 20. For convenience, the pixel circuit 20 that is provided at a point corresponding to the intersection of m-th data line Xm and n-th scan line Yn and that is connected between the data line Xm and the scan line Yn will be described.

The pixel circuit 20 includes a driving transistor Q1, a switching transistor Q2, a resetting transistor Q3, a compensation transistor Q4, a starting transistor Q5, and a holding capacitor C1 and a capacitor C2 functioning as capacitive elements.

Each of the switching transistor Q2 functioning as a first transistor, the resetting transistor Q3 functioning as a third transistor, the compensation transistor Q4 functioning as a fourth transistor, and the starting transistor Q5 functioning as a fifth transistor is formed of an N-channel FET. The driving transistor Q1 functioning as a second transistor is formed of a P-channel FET.

A drain of the driving transistor Q1 is connected to the anode of the organic EL element 21 via the starting transistor Q5, and a source of the driving transistor Q1 is connected to a power line L1 to which a power voltage VOEL is supplied. The holding capacitor C1 is connected between the gate of the driving transistor Q1 and the power line L1. The compensation transistor Q4 is connected between the gate and drain of the driving transistor Q1. A gate of the compensation transistor Q4 is connected to a second sub-scan line Yn2 forming the scan line Yn. A second scan signal SCn2 is input from the second sub-scan line Yn2.

The gate of the driving transistor Q1 is connected to the data line Xm via the capacitor C2 and the switching transistor Q2. A gate of the switching transistor Q2 is connected to a first sub-scan line Yn1 forming the scan line Yn. A first scan signal SCn1 is input from the first sub-scan line Yn1. The resetting transistor Q3 is connected in parallel to the holding capacitor C1. A gate of the resetting transistor Q3 is connected to a fourth sub-scan line Yn4 forming the scan line Yn. A reset signal SRESTn is input from the fourth sub-scan line Yn4. A gate of the starting transistor Q5 is connected to a third sub-scan line Yn3 forming the scan line Yn. A third scan signal SCn3 is input from the third sub-scan line Yn3.

Figure 4:
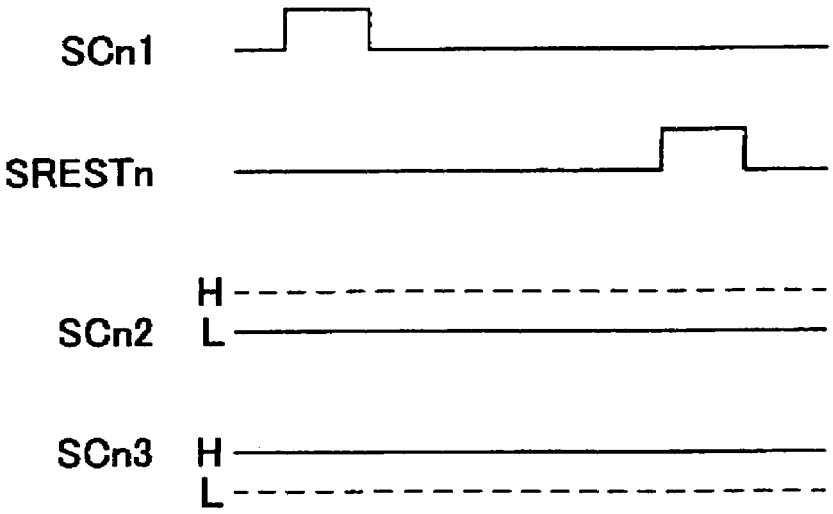
FIG. 4 illustrates timing charts illustrating scan-line selection performed in the case where the time-ratio gray-scale modulation is performed.

In the above-described pixel circuit 20, a two-level data voltage is written into the pixel circuit 20 corresponding to one of the scan lines selected in sequence. At the same instant, transmission of a current with a level corresponding to the two-level-data voltage to the organic EL element 21 is started. After a predetermined time period elapsed, the current transmission to the organic EL element 21 is stopped. Accordingly, time-division gray scale is achieved. More specifically, as shown in FIG. 4, the compensation transistor Q4 is held in a non-conduction (off) state and the starting transistor Q5 is held in a conduction (on) state in the sub frames SF1 to SF6, based on the second scan signal SCn2 and the third scan signal SCn3. Then, in the sub frames SF1 to SF6, the first scan signal SCn1 and the reset signal SRESTn are output for having on-and-off control over the switching transistor Q2 and the resetting transistor Q3 in predetermined timing. Subsequently, the gray scale is presented according to the digital-gray-scale modulation method.

In other words, when the scan signal SCn1 is output to the first sub-scan line Yn1 in the state where the compensation transistor Q4 is held in the non-conduction state and the starting transistor Q5 is held in the conduction state, the switching transistor Q2 is turned on. When the switching transistor Q2 is turned on, an electrical-charge amount corresponding to two-level digital data VDGDATAm is accumulated in the holding capacitor C1. The digital data VDGDATAm is output from the data line Xm, and the value thereof is of two level, that is, either "L level" or "H level". This digital data VDGDATAm that can be at either the "L level" or the "H level" is data for turning the driving transistor Q1 on or off. The holding capacitor C1 holding the digital data VDGDATAm keeps holding this digital data VDGDATAm that had been accumulated even though the scan signal SCn1 is lost and the switching transistor Q2 is turned off.

The driving transistor Q1 is controlled so as to be in an on state or an off state according to the nature of the accumulated digital data VDGDATAm. When the driving transistor Q1 is in the on state, a drive current is transmitted to the organic EL element 21. Subsequently, the organic EL element 21 emits light. Conversely, when the driving transistor Q1 is in the off state, the drive current transmission stops, and the organic EL element 21 stops emitting light.

When a reset signal SRESTn is output to the fourth sub-scan line Yn4, the resetting transistor Q3 shifts from the off state to the on state. When the resetting transistor Q3 is in the on state, a power voltage VOEL is applied from the power line L1 to the holding capacitor C1 via the resetting transistor Q3. Subsequently, the digital data VDGDATAm is erased and the potential of the gate of the driving transistor Q1 becomes equivalent to the potential of the power voltage VOEL. That is to say, the holding capacitor C1 is reset.

When the holding capacitor C1 is reset, the driving transistor Q1 enters the off state, and the organic EL element 21 that is emitting light, based on the digital data VDGDATAm, stops emitting light and waits until the next light-emission operation. That is to say, in the case where the time-division gray-scale modulation is performed, the time periods TL1 to TL6 where the organic EL element 21 of each pixel circuit 20 emits light is the time frame from when the scan signal SCn1 is output until the reset signal SRESTn is output.

Figure 5:
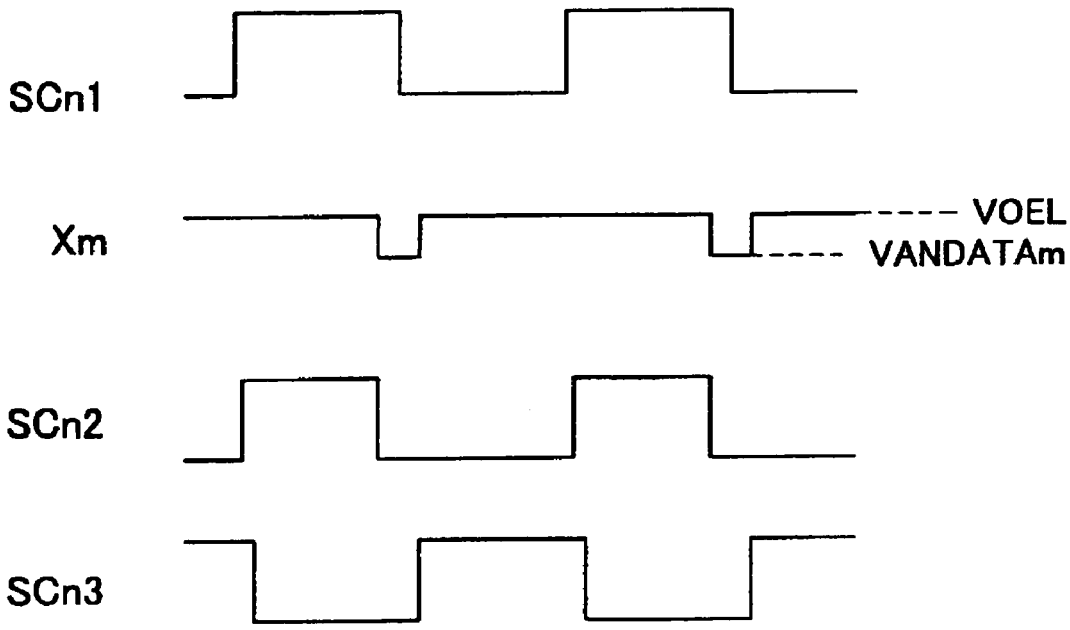
FIG. 5 illustrates timing charts illustrating scan-line selection performed in the case where analog-gray-scale modulation is performed.

In the pixel circuit 20, analog-gray-scale modulation is performed by rendering the voltage between the gate and source of the driving transistor Q1 as the threshold voltage of the transistor Q1 for driving. As shown in FIG. 5, the resetting transistor Q3 is kept in the non-conduction state, based on the reset signal SRESTn. Then, the first to third scan signals SCn1 to SCn3 for having on-and-off control over the switching transistor Q2, the compensation transistor Q4, and the starting transistor Q5 in predetermined timing are output. Subsequently, the gray scale is presented through the analog-gray-scale modulation.

In other words, when the H-level scan signal SCn1 is output to the first sub-scan line Yn1 during the resetting transistor Q3 is in the non-conduction state, the switching transistor Q2 enters the on state. At this time, the bias voltage (=VOEL) placed on the data line Xm is applied to the capacitor C2 via the switching transistor Q2. Further, in the previous cycle period (before the H-level scan signal SCn1 is output), since the starting transistor Q5 is in the on state due to the H-level scan signal SCn3 that is output to the third sub-scan line Yn3, a current can flow into the organic EL element 21. Therefore, the drain potential of the driving transistor Q1 is adequately close to the ground potential of the organic EL element 21. That is to say, the drain potential of the driving transistor Q1 adequately tends in a minus direction, so that the driving transistor Q1 is kept in an open state.

Then, when the scan signal SCn2 that is output to the second sub-scan line Yn2 shifts from the L level to the H level, the compensation transistor Q4 enters the on state. Further, the scan signal SCn3 that is output to the third sub-scan line Yn3 is lost (shifted to the L level), and the starting transistor Q5 enters the off state.

Since the compensation transistor Q4 is in the on state and the starting transistor Q5 is in the off state, the current of the power voltage VOEL flows into the gate of the driving transistor Q1 and boosts the potential of the gate. When the voltage placed on the gate is boosted to voltage Vg (=VOEL−Vth) obtained by subtracting the threshold voltage Vth of the driving transistor Q1 from the power voltage VOEL, the driving transistor Q1 is turned off.

The compensation transistor Q4 enters the off state when the scan signal SCn2 of the second sub-scan line Yn2 is shifted to the L level. At this moment, the voltage Vg (=VOEL−Vth) placed on the gate of the driving transistor Q1 is maintained.

After the voltage Vg (=VOEL−Vth) is held in the gate of the driving transistor Q1, an analog data voltage VANDATAm (<VOEL) is transmitted from the data line Xm. At this time, the driving transistor Q1 and the compensation transistor Q4 are in the off state. Therefore, the gate side of the driving transistor Q1 of the capacitor C2 is in a floating state. Subsequently, the voltage Vg held in the gate of the driving transistor Q1 decreases according to the analog data voltage VANDATAm due to the capacitive coupling between the capacitor C2 and the holding capacitor C1. In this state, the scan signal SCn1 of the first sub-scan line Yn1 is shifted to the L level, and the switching transistor Q2 is turned off. Since the switching transistor Q2 is turned off, the voltage Vg held in the gate of the driving transistor Q1 is maintained at the level of the potential that dropped according to the analog data voltage VANDATAm.

Then, an H-level scan signal SCn3 is output from the third sub-scan line Yn3, and the starting transistor Q5 enters the on state. Since the starting transistor Q5 is turned on, the driving transistor Q1 enters the conduction state corresponding to the value of this analog-data voltage VANDATAm. Further, a drive current corresponding to the analog data voltage VANDATAm is transmitted to the organic EL element 21. The organic EL element 21 emits light with luminance corresponding to the analog data voltage VANDATAm.

The scan-line driving circuit 12 selects one from among the plurality of scan lines Y1 to Yn. That is to say, the scan-line driving circuit 12 is a circuit that outputs a scan signal and drives a group of pixel circuits 20 connected to the selected scan line. The scan-line driving circuit 12 outputs scan signals SC1 to SCn to the scan lines Y1 to Yn in predetermined timing, respectively, based on various types of signals transmitted from the control circuit 14.

More specifically, according to the above-described gray-scale modulation method, two-level data voltages are written into the pixel circuits 20 corresponding to one of the scan lines that are selected in sequence. At the same instant, transmission of currents with a level corresponding to the two-level data voltages to the organic EL elements 21 is started. Then, after the predetermined time elapsed, the current transmission to the organic EL elements 21 is stopped. In this case, groups of the pixel circuits on the scan lines Y1 to Yn need to be driven in sequence in the sub frames SF1 to SF6. Therefore, the scan-line driving circuit 12 generates and outputs the scan signals SC1 to SCn for selecting the scan lines Y1 to Yn in sequence in the period of sub frames SF1 to SF6, so as to display an image corresponding to the one frame. When the predetermined time (a light-emission time) elapses after the scan-line driving circuit 12 outputs the scan signals SC 1 to SCn to the scan lines Y1 to Yn, the scan signals SC1 to SCn corresponding thereto, respectively, the scan-line driving circuit 12 outputs reset signals SREST1 to SRESTn to the corresponding scan lines Y1 to Yn, respectively.

In other words, it is arranged that the organic EL elements 21 emit light only in the light-emission time periods TL1 to TL6 in the sub frames SF1 to SF6, respectively.

In the case where the above-described analog-gray-scale-modulation method is applied, the scan-line driving circuit 12 outputs the scan signals SCI to SCn to the scan lines Y1 to Yn in the predetermined timing, based on the various types of signals transmitted from the control circuit 14.

As shown in FIG. 2, the data-line driving circuit 13 has a digital-data-voltage output circuit 13*a* functioning as a first data-voltage output circuit and an analog-data-voltage output circuit 13*b* functioning as a second data-voltage output circuit for each of the data lines X1 to Xm.

When the digital-data voltages VDGDATA1 to VDGDATAm are input from the control circuit 14 to the digital-data-voltage output circuit 13*a*, the digital-data-voltage output circuit 13*a* outputs the digital-data voltages VDGDATA1 to VDGDATAm to the corresponding data lines X1 to Xm via the first switch Q1, in synchronization with the scan signals SC1 to SCn. Further, when the analog-data voltages VANDATA1 to VANDATAm are input from the control circuit 14 to the analog-data-voltage output circuit 13*b*, the analog-data-voltage output circuit 13*b* outputs the analog-data voltages VANDATA1 to VANDATAm to the corresponding data lines X1 to Xm via the second switch Q12, in synchronization with the scan signals SC1 to SCn.

The first switch Q11 and the second switch Q12 select either the digital-data voltages VDGDATA1 to VDGDATAm or the analog-data voltages VANDATA1 to VANDATAm and output them to the data lines X1 to Xm. Each of these switches is formed of an N-channel FET. When a first control signal SG1 is input from the control circuit 14 to a gate terminal of the first switch Q11, the first switch Q11 is turned on. Then, the first switch Q11 outputs the digital-data voltages VDGDATA1 to VDGDATAm to the data lines X1 to Xm. When a second control signal SG2 is input from the control circuit 14 to a gate terminal of the second switch Q12, the second switch Q12 is turned on. Then, the second switch Q12 outputs the analog-data voltages VANDATA1 to VANDATAm to the data lines X1 to Xm.

Bias voltages (the power voltages VOEL) are transmitted to the data lines X1 to Xm when the digital-data voltages VDGDATA1 to VDGDATAm and the analog-data voltages VANDATA1 to VANDATAm are not transmitted thereto.

In other words, when the scan-line driving circuit 12 outputs a scan signal to one of the scan lines, the data-line driving circuit 13 outputs the digital-data voltages VDGDATA1 to VDGDATAm to the pixel circuits 20 on the selected scan line in the case where the digital-gray-scale modulation is performed. In the case where the analog-gray-scale modulation is performed, the data-line driving circuit 13 outputs the analog-data-voltages VANDATA1 to VANDATAm to the pixel circuits 20 on the selected scan line.

Upon receiving image data D from an external device (not shown), the control circuit 14 functioning as a control device, a two-level-data-voltage generation circuit, and a multilevel-data-voltage generation circuit determines whether the gray scale should be controlled according to the digital-gray-scale-modulation method or the analog-gray-scale-modulation method, based on the image data D.

In this embodiment, if the image data D is first display data for producing a freeze-frame picture display, such as a character display, the gray scale is controlled according to the digital-gray-scale-modulation method. However, if the image data D is second display data for producing a display for moving images, a movie, and so forth, the gray scale is controlled according to the analog-gray-scale-modulation method. That is to say, the control circuit 14 controls the scan-line driving circuit 12 and the data-line driving circuit 13 so that the digital-gray-scale-modulation method (the time-ratio gray-scale modulation method) is used in the case where significantly high display quality is unnecessary, for example, in the case where a freeze-frame picture display is produced, and the analog-gray-scale-modulation method is used in the case where high display quality is needed, for example, in the case where a moving-image display is produced.

In the case where the time-ratio gray-scale-modulation method is used, the control circuit 14 divides one frame of the image data D into six sub frames and presents one image in 64 gray scale through the organic EL display 10, by using the divided six sub frames SF1 to SF6.

The control circuit 14 generates the digital data VDGDATA1 to VDGDATAm for the image data D corresponding to one frame, the digital data corresponding to the first to sixth sub frames SF1 to SF6, for the data-line driving circuit 13. The digital data VDGDATA1 to VDGDATAm is transmitted to the pixel circuits 20 on the scan lines Y1 to Yn.

At this time, the control circuit 14 generates digital data VDGDATA1 to VDGDATAm for presenting one-level gray scale in the first sub frame SF1, digital data VDGDATA1 to VDGDATAm for presenting two-level gray scale in the second sub frame SF2, and digital data VDGDATA1 to VDGDATAm for presenting four-level gray scale in the third sub frame SF3, respectively. Further, the control circuit 14 generates digital data VDGDATA1 to VDGDATAm for presenting eight-level gray scale in the fourth sub frame SF4 and digital data VDGDATA1 to VDGDATAm for presenting sixteen-level gray scale in the fifth sub frame SF5, respectively. Further, the control circuit 14 generates digital data VDGDATA1 to VDGDATAm for presenting thirty-two-level gray scale in the sixth sub frame SF6.

The digital data VDGDATA1 to VDGDATAm in the first to sixth sub frames SF1 to SF6 is output to the digital-data-voltage output circuit 13*a* of the data-line driving circuit 13 in predetermined timing. At this time, the control circuit 14 outputs a first control signal SG1 to the first switch Q11 of the data-line driving circuit 13.

In the case where the digital-gray-scale modulation is performed, the control circuit 14 controls the timing of making the scan-line driving circuit 12 sequentially output the scan signals SCn (SCn1 to SCn3) for selecting the scan lines in sequence and controlling the pixel circuits 20, the scan signals being generated in the scan-line driving circuit 12.

Further, the control circuit 14 controls the timing of making the scan-line driving circuit 12 sequentially output reset signals SREST1 to SRESTn in the sub frames SF1 to SF6 to the scan lines Y1 to Yn. Incidentally, in the first sub frame SF1, the scan-line driving circuit 12 outputs the reset signals SREST1 to SRESTn after a time TL1 elapsed since the scan signals SC1 to SCn were output. In the second sub frame SF2, the scan-line driving circuit 12 outputs the reset signals SREST1 to SRESTn after a time TL2 (=2×TL1) elapsed since the scan signal SCn1 was output. In the third sub frame SF3, the scan-line driving circuit 12 outputs the reset signals SREST1 to SRESTn after a time TL3 (=4×TL1) elapsed since the scan signal SCn1 was output. In the fourth sub frame SF4, the scan-line driving circuit 12 outputs the reset signals SREST1 to SRESTn after a time TL4 (=8×TL1) elapsed since the scan signal SCn1 was output. In the fifth sub frame SF5, the scan-line driving circuit 12 outputs the reset signals SREST1 to SRESTn after a time TL5 (=16×TL1) elapsed since the scan signal SCn1 was output. In the sixth sub frame SF6, the scan-line driving circuit 12 outputs the reset signals SREST1 to SRESTn after a time TL6 (=32×TL1) elapsed since the scan signal SCn1 was output.

In the case where the analog-gray-scale modulation is performed, the control circuit 14 generates analog-data voltages VANDATA1 to VANDATAm, based on image data D corresponding to one frame, for each of the scan lines Y1 to Yn that are selected in sequence. The analog-data voltages VANDATA1 to VANDATAm is transmitted to the pixel circuits 20 connected to the scan lines Y1 to Yn. Subsequently, the image data D is presented through the organic EL display 10. The control circuit 14 outputs the generated analog-data voltages VANDATA1 to VANDATAm to the analog-data-voltage output circuit 13*b* of the data-line driving circuit 13 in predetermined timing. At the same instant, the control circuit 14 outputs a second control signal SG2 to the second switch Q12 of the data-line driving circuit 13.

In the case where the analog-gray-scale modulation is performed, the control circuit 14 controls the timing of making the scan-line driving circuit 12 sequentially output the scan signals SCn (SCn1 to SCn3) for selecting the scan lines in sequence and controlling the pixel circuits 20 on the selected scan lines, the scan signals being generated in the scan-line driving circuit 12.

The operation of the above-described organic EL display 10 will now be described.

Upon receiving the image data D from the external device, the control circuit 14 determines whether the image data D is freeze-image data or moving-image data. If the image data D is the freeze-image data, the organic EL display 10 enters digital-gray-scale-modulation mode. If the image data D is the moving-image data, the organic EL display 10 enters analog-gray-scale-modulation mode.

First, the digital-gray-scale-modulation mode will be described. The control circuit 14 generates digital data VDGDATA1 to VDGDATAm for the image data D corresponding to one frame, the digital data corresponding to the first to sixth sub frames SF1 to SF6, for the data-line driving circuit 13. The digital data VDGDATA1 to VDGDATAm is transmitted to the pixel circuits 20 on the scan lines Y1 to Yn. The digital data VDGDATA1 to VDGDATAm in the first to sixth sub frames SF1 to SF6 is output to the digital-data-voltage output circuit 13*a* of the data-line driving circuit 13 in predetermined timing. At this time, the control circuit 14 outputs a first control signal SG1 to the first switch Q11 of the data-line driving circuit 13.

Further, the control circuit 14 controls the timing of making the scan-line driving circuit 12 sequentially output the scan signals SCn (SCn1 to SCn3) for selecting the scan lines in sequence and controlling the pixel circuits 20, the scan signals being generated in the scan-line driving circuit 12. Further, the control circuit 14 controls the timing of making the scan-line driving circuit 12 sequentially output reset signals SREST1 to SRESTn in the sub frames SF1 to SF6 to the scan lines Y1 to Yn.

Then, the scan-line driving circuit 12 outputs the scan signals SCn (SCn1 to SCn3) for the first sub frame SF1 in sequence and selects the scan lines Yn in sequence.

Further, the scan-line driving circuit 12 outputs the reset signals SRESTn after the time TL1 elapsed since the scan signals SCn were output.

Every time each of the scan lines Yn is selected, the data-line driving circuit 13 outputs the digital data VDGDATA1 to VDGDATAm in the first sub frame SF1 in sequence to the pixel circuits 20 on the selected scan line. Therefore, the pixel circuits 20 on the selected scan line operate (emit light or go out), based on the digital data VDGDATA1 to VDGDATAm. The pixel circuits 20 go out in response to the reset signals SRESTn after the time TL1 elapsed.

When the last transmission of the digital data VDGDATA1 to VDGDATAm in the first sub frame SF1 to the pixel circuits 20 on the scan lines Y1 to Yn is finished, the scan-line driving circuit 12 outputs the scan signals SCn (SCn1 to SCn3) for the second sub frame in sequence and selects the scan lines Y1 to Yn in sequence. Further, the scan-line driving circuit 12 outputs the reset signals SREST1 to SRESTn after the time TL2 (=2×TL1) elapsed since the scan signals SCn were output.

As in the above-described case, the data-line driving circuit 13 outputs the digital-data voltages VDGDATA1 to VDGDATAm in the second sub frame SF2 in sequence to the pixel circuits 20 on the selected scan lines. Therefore, the pixel circuits 20 on the selected scan lines operate (emit light or go out), based on the digital-data voltages VDGDATA1 to VDGDATAm, as in the above-described case. Further, the pixel circuits 20 go out in response to the reset signals SRESTn after the time TL2 elapsed.

The same operations as in the above-described case are repeated in the third to sixth sub frames SF3 to SF6, so that a display of an image corresponding to one frame is produced. When the operation for producing the display of the image corresponding to one frame is finished, operations for producing a display of an image for the next frame are performed as in the above-described manner.

The analog-gray-scale-modulation mode will be described below. The control circuit 14 generates the analog-data voltages VANDATA1 to VANDATAm for the pixel circuits 20 connected to the scan lines Y1 to Yn. The scan lines Y1 to Yn are selected in sequence, based on the image data D corresponding to one frame. The analog-data voltages VANDATA1 to VANDATAm are generated for each of the scan lines Y1 to Yn. The control circuit 14 outputs the generated analog-data-voltages VANDATA1 to VANDATAm to the analog-data-voltage output circuit 13*b* of the data-line driving circuit 13 in predetermined timing. At this time, the control circuit 14 outputs the second control signal SG2 to the second switch Q12 of the data-line driving circuit 13. Further, the control circuit 14 controls the timing of making the scan-line driving circuit 12 sequentially output the scan signals SCn (SCn1 to SCn3) for selecting the scan lines in sequence and controlling the pixel circuits 20 on the selected scan lines, the scan signals being generated in the scan-line driving circuit 12.

Then, the scan-line driving circuit 12 outputs the scan signals SCn (SCn1 to SCn3) in sequence and selects the scan lines Y1 to Yn in sequence. Every time each of the scan lines Y1 to Yn is selected, the data-line driving circuit 13 outputs the analog-data-voltages VANDATA1 to VANDATAm in sequence to the pixel circuits 20 on the selected scan line. Therefore, the organic EL element 21 of each of the pixel circuits 20 on the selected scan line emits light with luminance corresponding to the analog-data voltages VANDATA1 to VANDATAm.

The characteristic of the above-described organic EL display 10 will be described below.

According to the embodiment, the gray scale is presented by the digital-gray-scale modulation for producing a freeze-frame picture display. The gray scale can also be presented by the analog-gray-scale modulation for producing a moving-image display. However, in the case where a high-quality freeze-frame picture display is required, the gray scale can be presented by the analog-gray-scale modulation. Further, in the case where a high-quality moving image picture display is required, the gray scale can be presented by the digital-gray-scale modulation.

Further, the gray scale can be presented by the digital-gray-scale modulation for producing a character-image display, and the gray scale can also be presented by the analog-gray-scale modulation for producing an image display. That is to say, the gray scale is presented by the digital-gray-scale modulation, which requires low power consumption, in the case where high quality is unnecessary. On the other hand, the gray scale is presented by the analog-gray-scale modulation in the case where high quality is required.

Accordingly, the organic EL display 10 requires a small amount of electrical power and achieves adequate display quality.

A second embodiment of the present invention will now be described with reference to FIG. 6. Each pixel circuit 20 according to this embodiment, the pixel circuit 20 functioning as an electronic circuit and/or a unit circuit, is different from that of the first embodiment. The difference will now be described in detail.

Figure 6:
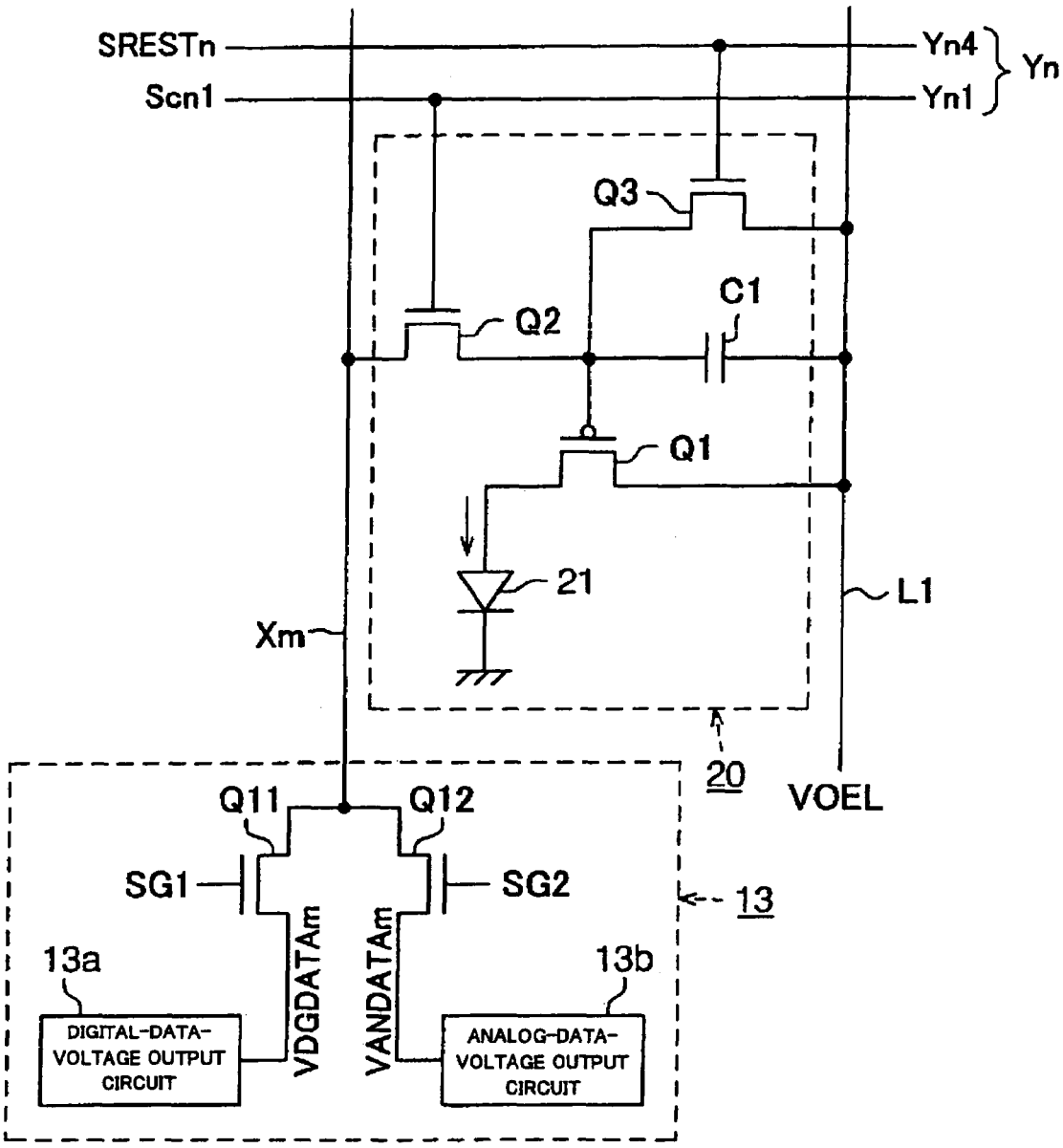
FIG. 6 is an exemplary circuit diagram illustrating a pixel circuit according to a second embodiment.

As shown in FIG. 6, the pixel circuit 20 of this embodiment, which is different from that of the first embodiment, does not have the compensation transistor Q4, the starting transistor Q5, and the capacitor C2. That is to say, the drain of the driving transistor Q1 is connected to the anode of the organic EL element 21, and the cathode of the organic EL element 21 is grounded. The source of the driving transistor Q1 is connected to the power line L1 to which the power voltage VOEL is transmitted. The holding capacitor C1 is connected between the gate of the driving transistor Q1 and the power line L1.

The gate of the driving transistor Q1 is connected to the data line Xm via the switching transistor Q2. The gate of the switching transistor Q2 is connected to the first sub-scan line Yn1 forming the scan line Yn. The first scan signals SCn1 are input from the first sub-scan line Yn1. The resetting transistor Q3 is connected in parallel to the holding capacitor C1. The gate of the resetting transistor Q3 is connected to the fourth sub-scan line Yn4 forming the scan line Yn. The reset signal SRESTn is input from the fourth sub-scan line Yn4. Therefore, in this embodiment, the scan line Yn is formed of the first sub-scan line Yn1 and the fourth sub-scan line Yn4. The second sub-scan line Yn2 and the third sub-scan line Yn3 are omitted.

In this pixel circuit 20, when the digital-gray-scale modulation is performed, the scan signal SCn1 is output to the first sub-scan line Yn1, and the switching transistor Q2 enters the on state. When the switching transistor Q2 enters the on state, an electrical-charge amount according to the digital data VDGDATAm is transmitted from the digital-data-voltage output circuit 13*a* and accumulated in the holding capacitor C1 via the data line Xm. The value of the digital data VDGDATAm is at either the "L level" or the "H level".

The driving transistor Q1 is controlled so as to be in the on state or the off state according to the nature of the accumulated digital data VDGDATAm. When the driving transistor Q1 is in the on state, a drive current is transmitted to the organic EL element 21, and the organic EL element 21 emits light. Conversely, when the driving transistor Q1 is in the off state, the drive-current transmission is stopped, and the organic EL element 21 stops emitting light.

Then, the reset signal SRESTn is output to the fourth sub-scan line Yn4, and the resetting transistor Q3 is shifted from the off state to the on state. When the resetting transistor Q3 is in the on state, the power voltage VOEL is applied from the power line L1 to the holding capacitor C1 via the resetting transistor Q3. Subsequently, the previous digital data VDGDATAm is erased and the potential of the gate of the driving transistor Q1 becomes the potential of the power voltage VOEL. That is to say, the holding capacitor C1 is reset. Therefore, in the case where the time-ratio gray-scale modulation that is the same as that in the first embodiment is performed, the time periods TL1 to TL6 where the organic EL element 21 of each pixel circuit 20 emits light is a time period from when the scan signal SCn1 is output until the reset signal SRESTn is output.

In the pixel circuit 20, in the case where the analog-gray-scale modulation is performed by rendering the voltage between the gate and source of the driving transistor Q1 as the threshold voltage of the transistor Q1 for driving, the resetting transistor Q3 is kept in the non-conduction state, based on the reset signal SRESTn. Then, the first scan signal SCn1 for having on-and-off control over the switching transistor Q2 in predetermined timing is output. Subsequently, a gray-scale image produced by the analog-gray-scale modulation can be presented.

In other words, when the scan signal SCn1 is output to the first sub-scan line Yn1, the switching transistor Q2 enters the on state. When the switching transistor Q2 is in the on state, an electrical-charge amount according to the analog-data-voltage VANDATAm is transmitted from the analog-data-voltage output circuit 13*b* and accumulated in the holding capacitor C1 via the data line Xm. The driving transistor Q1 enters a conduction state corresponding to the value of the analog-data voltage VANDATAM accumulated in this holding capacitor C1. A drive current corresponding to the conduction state of the driving transistor Q1 is transmitted to the organic EL element 21. Then, the organic EL element 21 emits light with luminance corresponding to the analog-data voltage VANDATAm.

In the pixel circuit 20 of this embodiment, the gray scale is presented by the digital-gray-scale modulation for producing a freeze-frame picture display. The gray scale can also be presented by the analog-gray-scale modulation for producing a moving-image display. However, in the case where a high-quality freeze-frame picture display is required, the gray scale can be presented by the analog-gray-scale modulation. Further, in the case where a moving image picture display is required, the gray scale can be presented by the digital-gray-scale modulation. Further, the gray scale can be presented according to the digital-gray-scale modulation for producing a character-image display, and the gray scale can also be presented according to the analog-gray-scale modulation for producing an image display. That is to say, the gray scale is presented by the digital-gray-scale modulation, which requires low power consumption, in the case where high display quality is unnecessary. On the other hand, the gray scale is presented by the analog-gray-scale modulation in the case where high display quality is required. Accordingly, the organic EL display 10 formed of the pixel circuit 20 of this embodiment requires a small amount of electrical power and achieves adequate display quality.

A third embodiment of the present invention will now be described with reference to FIG. 7. Each pixel circuit 20 according to this embodiment, the pixel circuit 20 functioning as an electronic circuit and/or a unit circuit, is different from that of the first embodiment. Therefore, the difference will now be described in detail.

Figure 7:
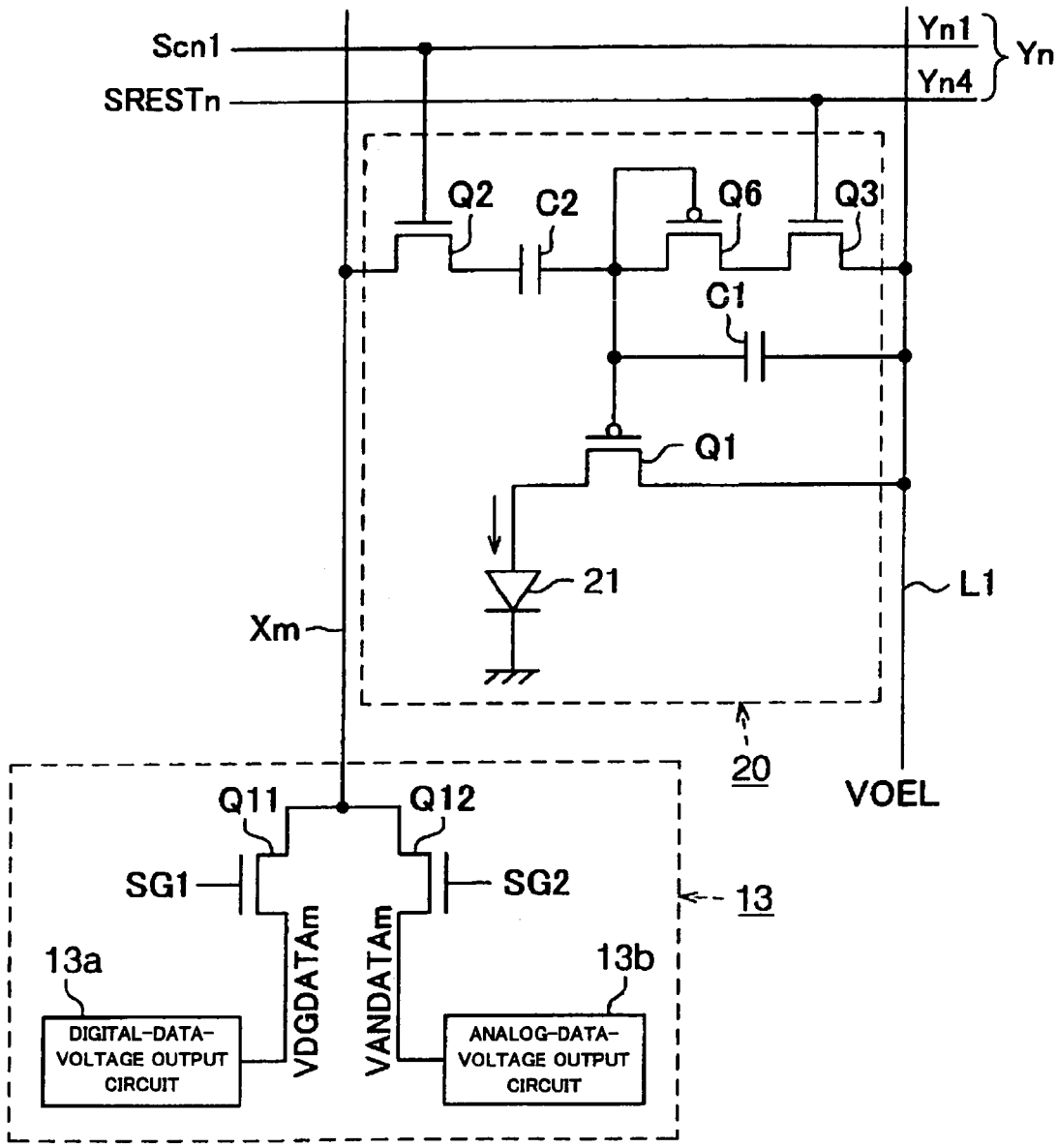
FIG. 7 is an exemplary circuit diagram illustrating a pixel circuit according to a third embodiment.

As shown in FIG. 7, the pixel circuit 20 of this embodiment, which is different from that of the first embodiment, does not have the compensation transistor Q4 and the starting transistor Q5. That is to say, the drain of the driving transistor Q1 is connected to the anode of the organic EL element 21, and the cathode of the organic EL element 21 is grounded. The source of the driving transistor Q1 is connected to the power line L1 to which the power voltage VOEL is transmitted. The holding capacitor C1 is connected between the gate of the driving transistor Q1 and the power line L1.

The gate of the driving transistor Q1 is connected to the data line Xm via the switching transistor Q2. The gate of the switching transistor Q2 is connected to the first sub-scan line Yn1 forming the scan line Yn. The first scan signals SCn1 are input from the first sub-scan line Yn1.

The source of the resetting transistor Q3 is connected to the power line L1 and the gate thereof is connected to the fourth sub-scan line Yn4 forming the scan line Yn. The drain of the resetting transistor Q3 is connected to the source of the compensation transistor Q6 formed of a P-channel transistor. The drain of the compensation transistor Q6 is connected to the gate of the driving transistor Q1. The gate and drain of the compensation transistor Q1 are connected to each other. That is to say, the gate and drain are diode-connected.

In this pixel circuit 20, in the case where the digital-gray-scale modulation is performed and the resetting transistor Q3 is in the off state, the switching transistor Q2 enters the on state when the H-level scan signal SCn1 is output to the first sub-scan line Yn1. When the switching transistor Q2 enters the on state, an electrical-charge amount corresponding to the digital data VDGDATAm is transmitted from the digital-data-voltage output circuit 13*a* and accumulated in the holding capacitor C1 via the data line Xm. The value of the digital data VDGDATAm is at either the "L level" or the "H level".

The driving transistor Q1 is controlled so as to be in the on state or the off state according to the nature of the accumulated digital data VDGDATAm. When the driving transistor Q1 is in the on state, a drive current is transmitted to the organic EL element 21, and the organic EL element 21 emits light. Conversely, when the driving transistor Q1 is in the off state, the drive-current transmission is stopped, and the organic EL element 21 stops emitting light.

Then, the reset signal SRESTn is output to the fourth sub-scan line Yn4, and the resetting transistor Q3 is shifted from the off state to the on state. When the resetting transistor Q3 is in the on state, the power voltage VOEL is applied from the power line L1 to the compensation transistor Q6 via the resetting transistor Q3, and the compensation transistor Q6 is turned on. Since the compensation transistor Q6 is turned on, the value of the gate voltage of the driving transistor Q1 becomes equivalent to that of a voltage obtained by subtracting the threshold voltage of the compensation transistor Q6 from the power voltage VOEL. That is to say, in the case where the driving transistor Q1 is turned on, based on the nature of the digital data VDGDATAm, and the organic EL element 21 emits light by the drive current transmitted thereto, the gate voltage of the driving transistor Q1 increases.

That is to say, the holding capacitor C1 is reset, the driving transistor Q1 is turned off, and the organic EL element 21 stops emitting light. Therefore, in the case where the time-ratio gray-scale modulation that is the same as that in the above described embodiment is performed, the time periods TL1 to TL6 where the organic EL element 21 of each pixel circuit 20 emits light is a time period from when the scan signal SCn1 is output until the reset signal SRESTn is output.

In the pixel circuit 20, in the case where the analog-gray-scale modulation is performed by rendering the voltage between the gate and source of the driving transistor Q1 as the threshold voltage of the transistor Q1 for driving, the scan signal SCn1 is output to the first sub-scan line Yn1. Then, the switching transistor Q2 enters the on state. At this instant, the bias voltage (=VOEL) on the data line Xm is applied to the capacitor C2 via the switching transistor Q2.

Subsequently, the H-level reset signal SRESTn is output to the fourth sub-scan line Yn4, and the resetting transistor Q3 enters the on state. When the resetting transistor Q3 enters the on state, the power voltage VOEL is applied to the compensation transistor Q6 via the resetting transistor Q3, whereby the compensation transistor Q6 is turned on. Subsequently, the value of the gate voltage of the driving transistor Q1 is boosted to that of the threshold voltage (Vth) of the compensation transistor Q6, whereby the driving transistor Q1 is turned off.

When the reset signal SRESTn is erased, the resetting transistor Q3 enters the off state. At this instant, the voltage Vg (=VOEL−Vth) on the gate of the driving transistor Q1 is maintained.

When the voltage Vg (=VOEL−Vth) in the gate of the driving transistor Q1 is maintained, the analog-data voltage VANDATAm (<VOEL) is supplied from the data line Xm. Since the driving transistor Q1 and the resetting transistor Q3 are in the off state, the gate side of the driving transistor Q1 of the capacitor C2 is in the floating state. Subsequently, the voltage Vg in the gate of the driving transistor Q1 decreases according to the analog-data voltage VANDATAm due to the capacitive coupling between the capacitor C2 and the holding capacitor C1.

In this state, the scan signal SCn1 on the first sub-scan line Yn1 is lost and the switching transistor Q2 is turned off. Since the switching transistor Q2 is turned off, the capacitor C2 enters the floating state, and the voltage Vg in the gate of the driving transistor Q1 is maintained at the level of the potential that decreased according to the analog-data voltage VANDATAm.

Subsequently, the driving transistor Q1 enters the conduction state corresponding to the value of this analog-data voltage VANDATAm, and a drive current corresponding to the analog-data voltage VANDATAm is applied to the organic EL element 21. The organic EL element 21 emits light with luminance corresponding to the analog-data voltage VANDATAm and keeps emitting light until the next light-emission operation.

In the pixel circuit 20 of this embodiment, the gray scale is presented by the digital-gray-scale modulation for producing a freeze-frame picture display. The gray scale can also be presented by the analog-gray-scale modulation for producing a moving-image display. However, in the case where a high-quality freeze-frame picture display is required, the gray scale can be presented by the analog-gray-scale modulation. Further, in the case where a high-quality moving image picture display is required, the gray scale can be presented by the digital-gray-scale modulation. Further, the gray scale can be presented by the digital-gray-scale modulation for producing a character-image display, and the gray scale can also be presented by the analog-gray-scale modulation for producing an image display. That is to say, the gray scale is presented by the digital-gray-scale modulation, which requires low power consumption, in the case where high display quality is unnecessary. On the other hand, the gray scale is presented by the analog-gray-scale modulation in the case where high display quality is required. Accordingly, the organic EL display 10 formed of the pixel circuit 20 of this embodiment requires a small amount of electrical power for achieving adequate display quality.

An electronic apparatus having the organic EL display 10 of the first embodiment mounted thereon, the organic EL display 10 functioning as the electro-optical device, will now be described with reference to FIGS. 8 and 9. The organic EL display 10 can be used for various kinds of electronic apparatuses such as a mobile personal computer, a mobile phone, a digital camera, and so forth.

Figure 8:
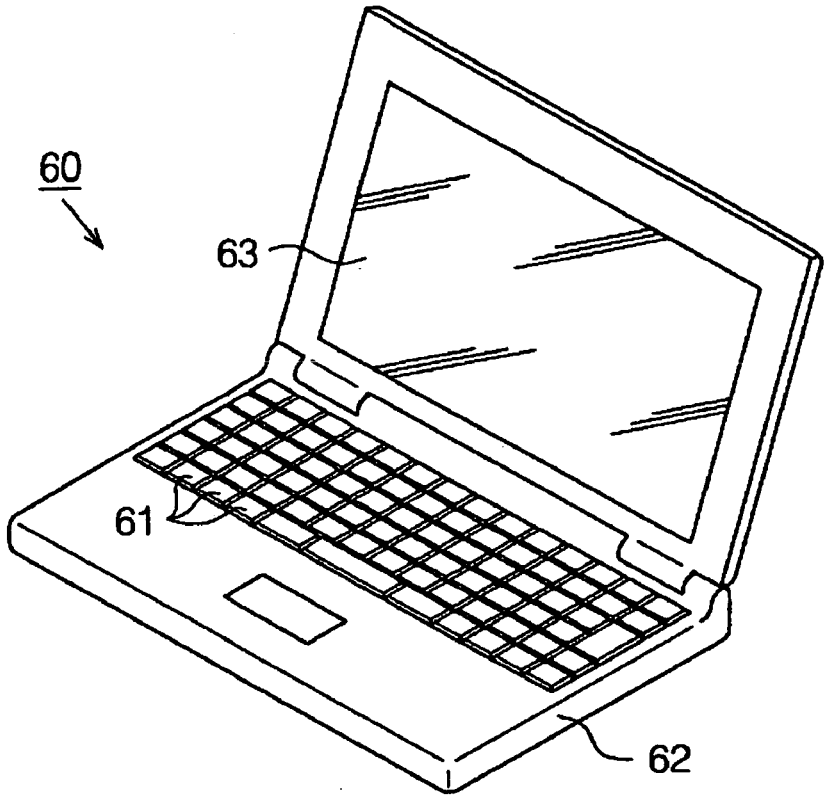
FIG. 8 is a perspective view of a mobile personal computer, the perspective view being provided for illustrating a fourth embodiment.

FIG. 8 is a perspective view of a mobile personal computer 60 having a main body 62 with a key board 61, and a display unit 63 using the organic EL display 10. In this case, the display unit 63 using the organic EL display 10 has the same effects as those in the above-described embodiments. Therefore, the personal computer 60 requires a small amount of electrical power for achieving adequate display quality.

Figure 9:
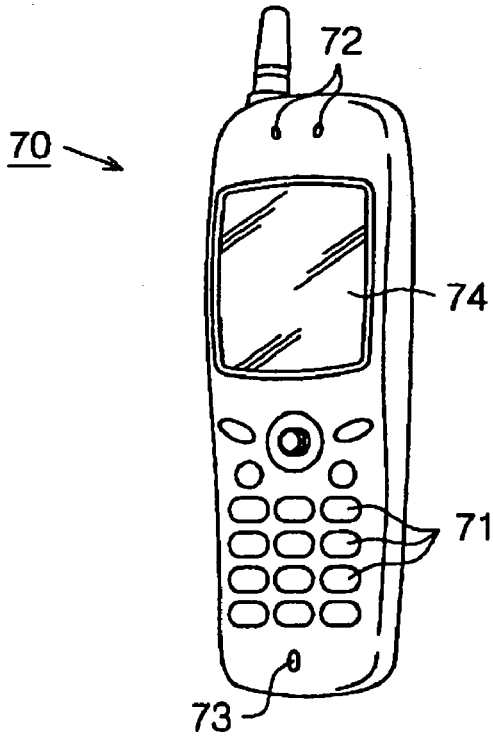
FIG. 9 is a perspective view of a mobile phone, the perspective view being provided for illustrating the fourth embodiment.

FIG. 9 is a perspective view of a mobile phone 70 having a plurality of operation buttons 71, reception ports 72, a transmission port 73, and a display unit 74 using the organic EL display 10. In this case, the display unit 74 using the organic EL display 10 has the same effects as those in the above-described embodiments. Therefore, the mobile phone 70 requires a small amount of electrical power for achieving adequate display quality.

It should be understood that the embodiments of the present invention may vary as below.

Figure 10:
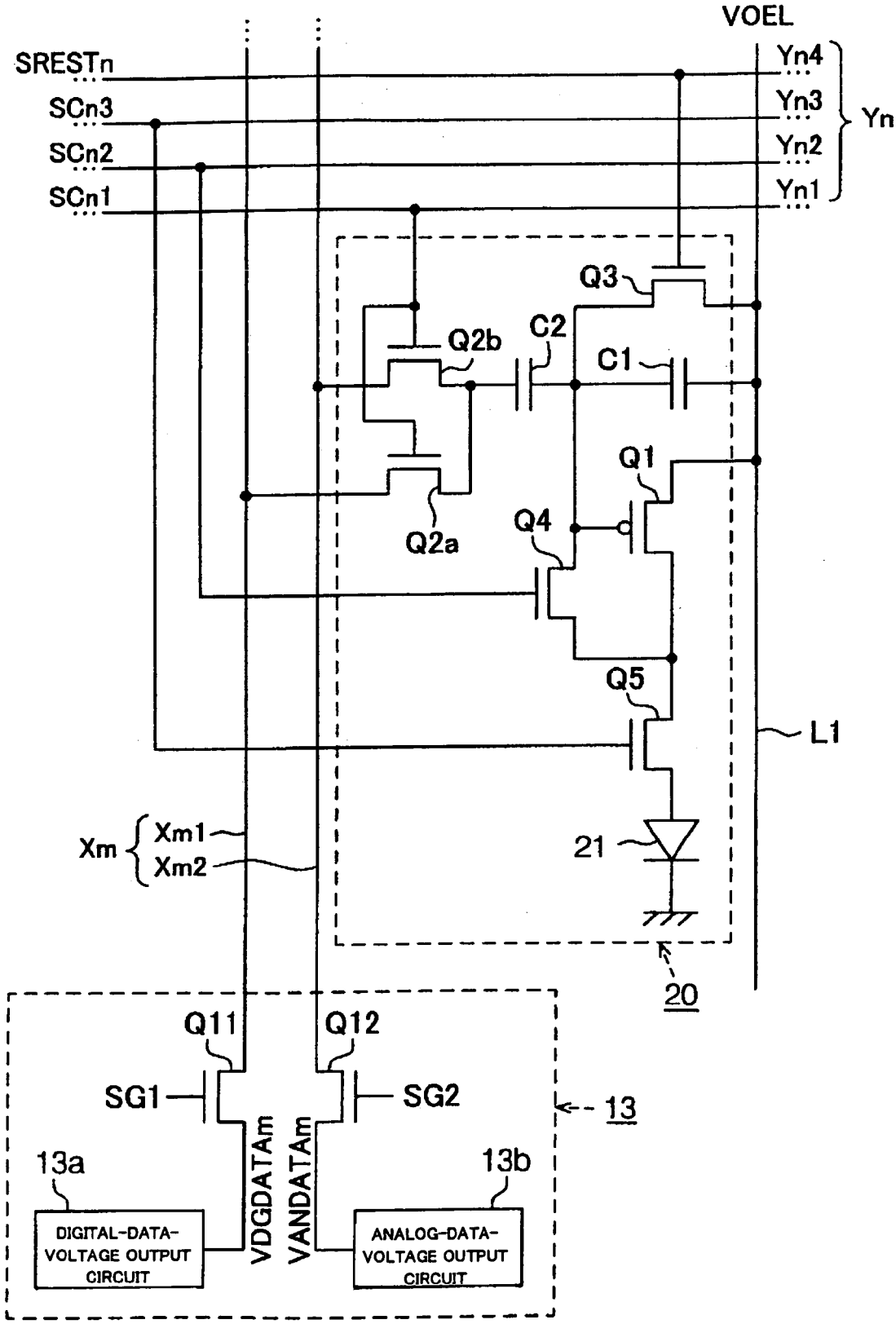
FIG. 10 is an exemplary circuit diagram of another pixel circuit according to the first embodiment.
Figure 11:
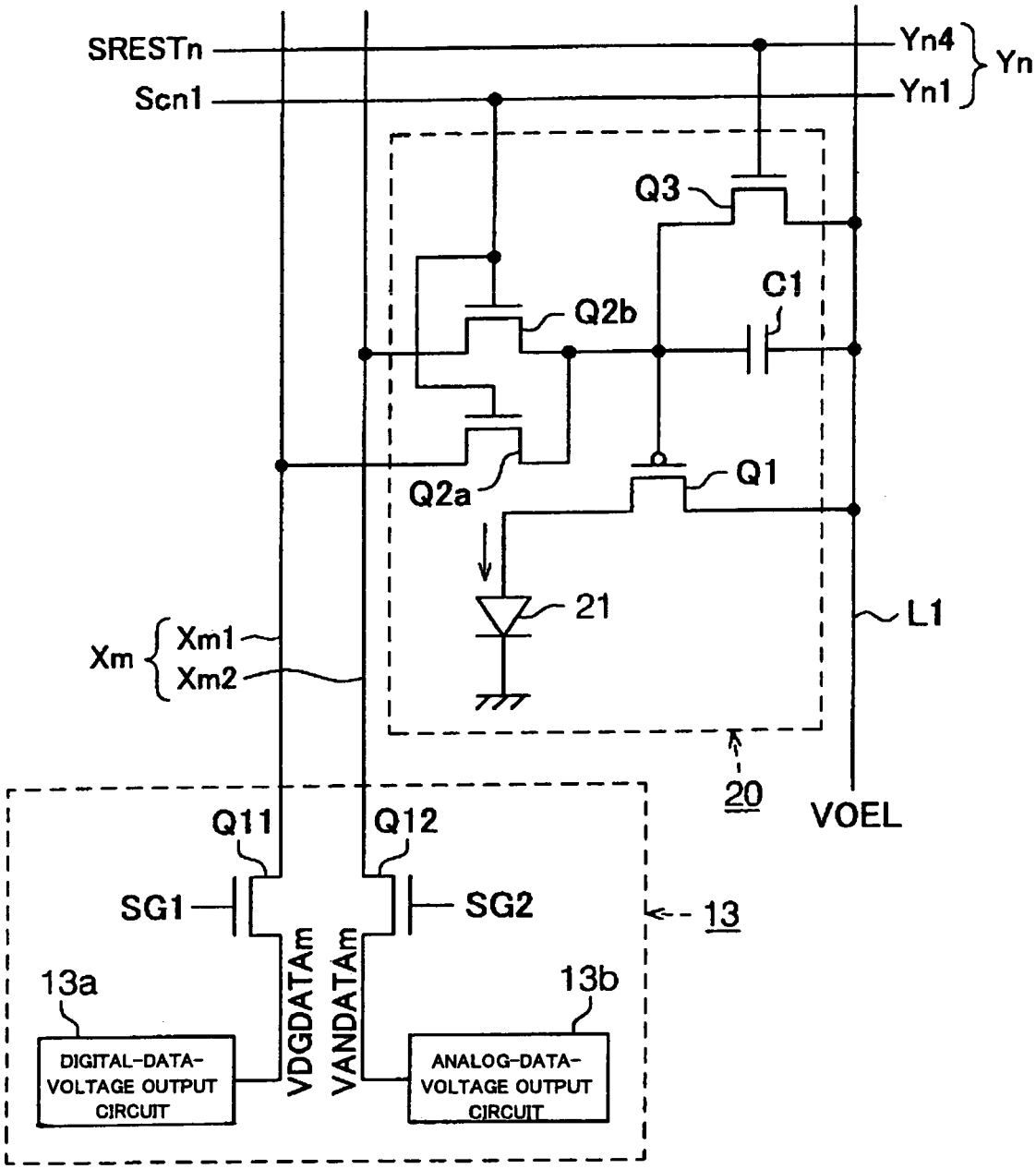
FIG. 11 is an exemplary circuit diagram of another pixel circuit according to the second embodiment.
Figure 12:
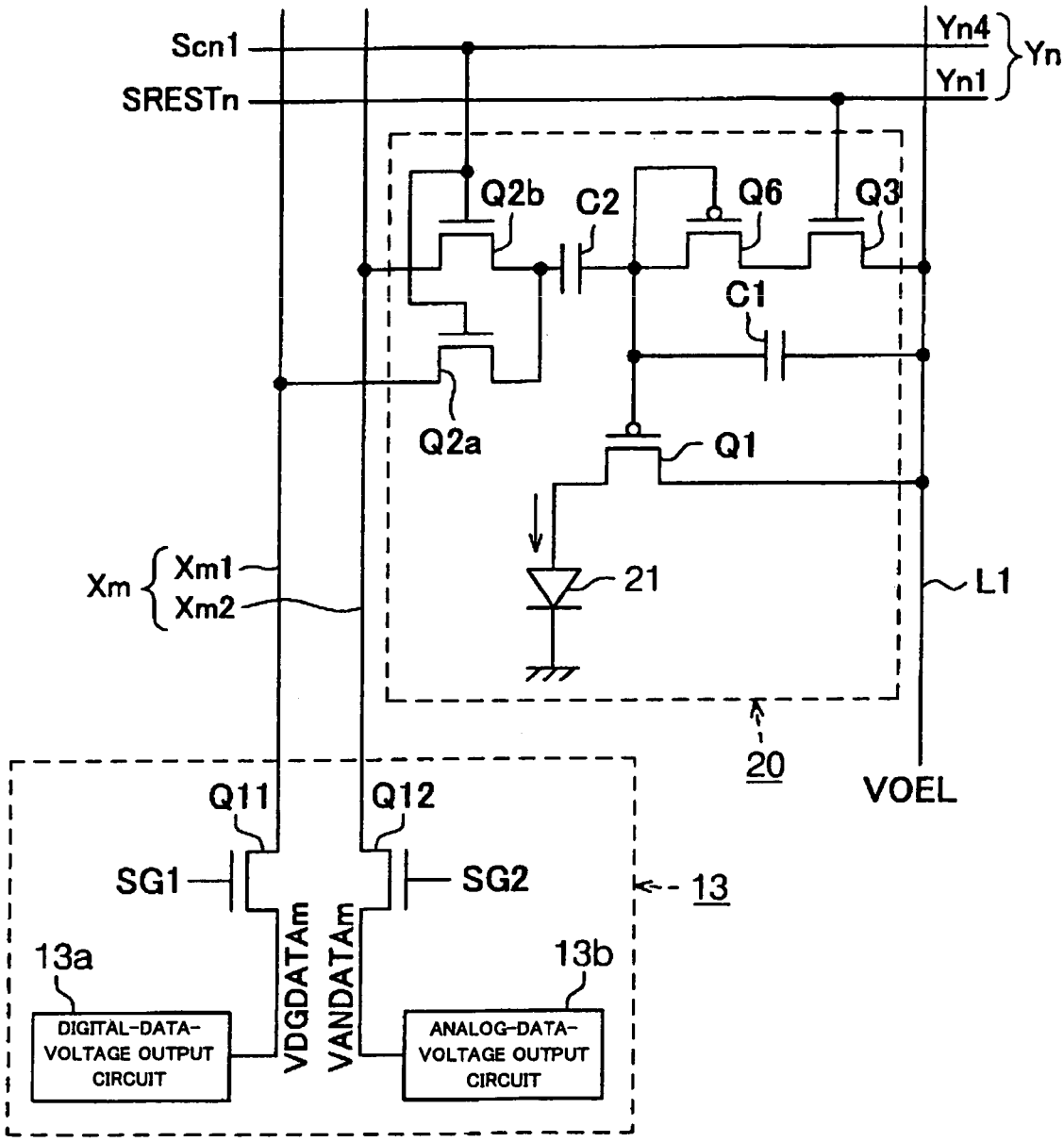
FIG. 12 is an exemplary circuit diagram of another pixel circuit according to the third embodiment.

In the first to third embodiments, as shown in FIGS. 1, 6, and 7, the digital-data voltage VDGDATAm and the analog-data voltage VANDATAm are transmitted to the holding capacitor C1 via the switching transistor Q2. As shown in FIGS. 10, 11, and 12, the data line Xm is formed of a first sub-data line Xm1 and a second sub-data line Xm2. The first sub-data line Xm1 is connected to the digital-data-voltage output circuit 13*a* via the first switch Q11, and the second sub-data line Xm2 is connected to the analog-data-voltage output circuit 13*b* via the second switch Q12. The first sub-data line Xm1 is connected to a first switching transistor Q2*a* and the second sub-data line Xm2 is connected to a second switching transistor Q2*b*.

In this state, the first switching transistor Q2*a* is turned on and the digital-data voltage VDGDATAm is transmitted from the digital-data-voltage output circuit 13*a* to the holding capacitor C1. Further, the second switching transistor Q2*b* is turned on and the analog-data voltage VANDATAm is transmitted from the analog-data-voltage output circuit 13*b* to the holding capacitor C1.

That is to say, the digital-data voltage VDGDATAm and the analog-data voltage VANDATAm may be transmitted to the holding capacitor C1 via different transistors, that is, the first switching transistor Q2*a* and the second switching transistor Q2*b*, respectively. In this case, the same effects as those in the first to third embodiments can be obtained.

In the first embodiment, the digital-gray-scale modulation is performed as the time-ratio gray-scale modulation. That is to say, the two-level-data voltage is written into the pixel circuit 20 corresponding to one of the scan lines selected in sequence. At the same instant, the current having the level corresponding to the two-level data voltage is supplied to the organic EL element 21. After a predetermined time period elapsed, the current supply to the organic EL element 21 is stopped. However, the digital-gray-scale modulation may be performed according to a simultaneous light-emission method. In another case, an area-gray-scale modulation may be performed as the digital-gray-scale modulation. In this case, each of the pixel circuits 20 is rendered as one sub pixel, and a plurality of the sub pixels is grouped. In the case where the digital-gray-scale modulation is performed, a suitable number of the grouped sub pixels are controlled so as to be in a non-light-emission state or in a light-emission state for presenting the gray scale.

According to the first embodiment, the reset signal SRESTn is input to the gate of the resetting transistor Q3 via the fourth sub-scan line Yn4. Subsequently, the two-level data voltage VDGDATAm held in the holding capacitor C1 is reset. In the first embodiment, the time-ratio gray-scale modulation is performed.

In this embodiment, however, the fourth sub-scan line Yn4 is omitted. Further, the N-channel FET forming the resetting transistor Q3 is changed into the P-channel FET. The gate of the resetting transistor Q3 formed of this P-channel FET is connected to the first sub-scan line Yn1. The value of the first scan signal SCn1 output to the first sub-scan line Yn1 is rendered tertiary. That is to say, the potential of the first scan signal SCn1 can be plus so that only the switching transistor Q2 becomes conductive, zero so that both the switching transistor Q2 and the resetting transistor Q3 become non-conductive, and minus so that only the resetting transistor Q3 becomes conductive.

In this case, therefore, the same effects as those in the above-described embodiments can be obtained. Further, the size of the pixel circuit 20 can be miniaturized and the aperture ratio thereof increases by the space for the omitted fourth sub-scan line Yn4.

In the first embodiment, where the time-ratio gray-scale modulation is performed, resetting is performed after the predetermined time by using the resetting transistor Q3. This method can be used for another type of time-ratio gray-scale modulation described below. That is to say, for writing a data voltage into all the pixel circuits 20, a reverse bias voltage is applied to the counter-electrode (the cathode) side of the organic EL element 21. After the data-voltage writing is finished, a forward bias voltage is applied to the counter-electrode side of the organic EL element 21, whereby a current with a level corresponding to the data voltage is transmitted. After a predetermined time elapsed, another reverse bias voltage is applied to the counter-electrode side of the organic EL element 21, whereby resetting is performed.

In the above-described embodiments, the suitable effects are obtained by using the pixel circuit 20 as the electronic circuit. However, the electronic circuit may drive another light-emission element other than the organic EL element 21. That is to say, the electronic circuit may drive an LED, an FED, and so forth.

Although the organic EL element 21 has been used in the above-described embodiments, an inorganic EL element may be used. That is to say, an inorganic EL display including the inorganic EL element may be used.

According to the present invention, adequate display quality can be achieved by a small amount of electrical power.

What is claimed is:

1. An electro-optical device, comprising:

a plurality of scan lines;

a plurality of data lines provided so as to cross the plurality of scan lines;

a unit circuit that is provided so as to correspond to each of the intersections of the plurality of scan lines and the plurality of data lines and that transmits a drive current according to a data voltage transmitted via a respective data line of the plurality of data lines to an electro-optical element; and a control device that generates and outputs either a two-level-data voltage for applying digital-gray-scale modulation to the electro-optical element or a multilevel-data voltage for applying analog-gray-scale modulation to the electro-optical element, based on image data, the control device including:

a two-level-data-voltage generation circuit that generates the two-level-data voltage for applying the digital-gray-scale modulation to the electro-optical element; and a multilevel-data-voltage generation circuit that generates the multilevel-data voltage for applying the analog-gray-scale modulation to the electro-optical element, the control device generating the two-level-data voltage for applying the digital-gray-scale modulation to the electro-optical element in low-electrical-power-consumption mode and the multilevel-data voltage for applying the analog-gray-scale modulation to the electro-optical element in non-low-electrical-power-consumption mode that drives the electro-optical element.

2. An electro-optical device, comprising:

a plurality of scan lines;

a plurality of data lines provided so as to cross the plurality of scan lines;

a unit circuit that is provided so as to correspond to each of the intersections of the plurality of scan lines and the plurality of data lines and that transmits a drive current according to a data voltage transmitted via a respective data line of the plurality of data lines to an electro-optical element; and a control device that generates and outputs either a two-level-data voltage for applying digital-gray-scale modulation to the electro-optical element or a multilevel-data voltage for applying analog-gray-scale modulation to the electro-optical element, based on image data, the control device generating the two-level-data voltage for applying the digital-gray-scale modulation to the electro-optical element in low-electrical-power-consumption mode and the multilevel-data voltage for applying the analog-gray-scale modulation to the electro-optical element in non-low-electrical-power-consumption mode that drives the electro-optical element, the control device including, between the control device and each of the data lines, a first output circuit that outputs the two-level-data voltage transmitted from the two-level-data-voltage generation circuit and a second output circuit that outputs the multilevel-data voltage transmitted from the multilevel-data-voltage generation circuit, and a switching circuit that outputs either the two-level-data voltage from the first output circuit or the multilevel-data voltage from the second output circuit to the data line.

3. An electro-optical device, comprising:

a plurality of scan lines;

a plurality of data lines provided so as to cross the plurality of scan lines;

a unit circuit that is provided so as to correspond to each of the intersections of the plurality of scan lines and the plurality of data lines and that transmits a drive current according to a data voltage transmitted via a respective data line of the plurality of data lines to an electro-optical element; and a control device that generates and outputs either a two-level-data voltage for applying digital-gray-scale modulation to the electro-optical element or a multilevel-data voltage for applying analog-gray-scale modulation to the electro-optical element, based on image data, the digital-gray-scale modulation being time-ratio gray-scale modulation.

4. The electro-optical device according to claim 3, the time-ratio gray-scale modulation being performed by writing the two-level-data voltage into the unit circuit corresponding to one of the plurality of scan lines selected in sequence and starting transmission of a current with a level according the two-level-data voltage to the electro-optical element at the same instant, and stopping the current transmission to the electro-optical element after a predetermined time.

5. A method for driving an electro-optical device, comprising:

a plurality of scan lines;

a plurality of data lines provided so as to cross the plurality of scan lines; and a unit circuit that is provided so as to correspond to each of intersections of the plurality of scan lines and the data lines and that transmits a drive current according to a data voltage transmitted via a respective data line of the plurality of data lines to an electro-optical element, the electro-optical element being driven by generating a two-level-data voltage for applying digital-gray-scale modulation to the electro-optical element in low-electrical-power-consumption mode and a multilevel-data voltage for applying analog-gray-scale modulation to the electro-optical element in non-low-electrical-power-consumption mode.

6. A method for driving an electro-optical device, comprising:

a plurality of scan lines;

a plurality of data lines provided so as to cross the plurality of scan lines; and a unit circuit that is provided so as to correspond to each of intersections of the plurality of scan lines and the data lines and that transmits a drive current according to a data voltage transmitted via a respective data line of the plurality of data lines to an electro-optical element, the electro-optical element being driven by generating a two-level-data voltage for applying digital-gray-scale modulation to the electro-optical element when image data is first display data and a multilevel-data voltage for applying analog-gray-scale modulation to the electro-optical element when the image data is second display data whose display quality is higher than that of the first display data.

7. The method for driving an electro-optical device according to claim 5, the digital-gray-scale modulation being time-ratio gray-scale modulation.

8. The method for driving an electro-optical device according to claim 7, the time-ratio gray-scale modulation being performed by writing the two-level-data voltage into the unit circuit corresponding to one of the plurality of scan lines selected in sequence and starting transmission of a current with a level according the two-level-data voltage to the electro-optical element at the same instant, and stopping the current transmission to the electro-optical element after a predetermined time.

9. An electronic apparatus, comprising:

an electro-optical device, the electro-optical device including:

a plurality of data lines;

a plurality of unit circuits;

a first data-voltage output circuit that outputs a two-level-data voltage as a data signal to each of the plurality of unit circuits via a respective data line of the plurality of data lines; and a second data-voltage output circuit that outputs a multilevel-data voltage to each of the plurality of unit circuits via a respective data line of the plurality of data lines.

10. An electro-optical device, comprising:

a plurality of scan lines;

a plurality of data lines provided so as to cross the plurality of scan lines;

a unit circuit that is provided so as to correspond to each of the intersections of the plurality of scan lines and the plurality of data lines and that transmits a drive current according to a data voltage transmitted via a respective data line of the plurality of data lines to an electro-optical element; and a control device that generates and outputs either a two-level-data voltage for applying digital-gray-scale modulation to the electro-optical element or a multilevel-data voltage for applying analog-gray-scale modulation to the electro-optical element, based on image data, the control device generating the two-level-data voltage for applying the digital-gray-scale modulation to the electro-optical element when the image data is first display data and the multilevel-data voltage for applying the analog-gray-scale modulation to the electro-optical element when the image data is second display data whose display quality is higher than that of the first display data that drives the electro-optical element.

* * * * *